US011605881B2

(12) United States Patent
Nemeth, III

(10) Patent No.: US 11,605,881 B2
(45) Date of Patent: Mar. 14, 2023

(54) CONCEALMENT SYSTEMS AND WIRELESS COMMUNICATION EQUIPMENT INSTALLATIONS AND METHODS INCLUDING SAME

(71) Applicant: RAYCAP IP DEVELOPMENT LTD, Nicosia (CY)

(72) Inventor: Joseph John Nemeth, III, Charleston, SC (US)

(73) Assignee: RAYCAP IP DEVELOPMENT LTD, Nicosia (CY)

( * ) Notice: Subject to any disclaimer, the term of this patent is extended or adjusted under 35 U.S.C. 154(b) by 213 days.

(21) Appl. No.: 16/856,106

(22) Filed: Apr. 23, 2020

(65) Prior Publication Data

US 2020/0350686 A1 Nov. 5, 2020

Related U.S. Application Data

(60) Provisional application No. 62/841,298, filed on May 1, 2019.

(51) Int. Cl.

| | |
|---|---|
| ***H01Q 1/24*** | (2006.01) |
| ***H01Q 1/42*** | (2006.01) |
| ***H01Q 1/12*** | (2006.01) |
| ***H01Q 1/44*** | (2006.01) |

(52) U.S. Cl.

CPC ..... *H01Q 1/246* (2013.01); *H01Q 1/424* (2013.01); *H01Q 1/1242* (2013.01); *H01Q 1/44* (2013.01)

(58) Field of Classification Search

CPC ..... H01Q 1/246; H01Q 1/424; H01Q 1/1242; H01Q 1/44; H01Q 1/42

See application file for complete search history.

(56) References Cited

U.S. PATENT DOCUMENTS

| | | | | |
|---|---|---|---|---|
| 5,852,424 | A | 12/1998 | Reineck et al. | |
| 7,067,188 | B1 | 6/2006 | Yang et al. | |
| 10,135,130 | B1 | 11/2018 | Bouchard | |
| 2017/0238432 | A1 | 8/2017 | Lapham et al. | |
| 2018/0062247 | A1* | 3/2018 | Umbert | H01Q 1/1228 |

FOREIGN PATENT DOCUMENTS

| | | | |
|---|---|---|---|
| CN | 108274879 | A | 7/2018 |
| CN | 109378587 | A | 2/2019 |
| EP | 3392306 | A1 | 10/2018 |

OTHER PUBLICATIONS

Extended European Search Report corresponding to European Application No. 20171907.7 (10 pages) (dated Oct. 6, 2020).

10202 IR Black Chromium Free Proprietary Compound Technical Data Sheet, Ferro Corporation (1 page) (2017).

(Continued)

*Primary Examiner* — Robert Karacsony

(74) *Attorney, Agent, or Firm* — Myers Bigel, P.A.

(57) ABSTRACT

A wireless communication equipment installation for wireless communication equipment includes a 5G New Radio (NR) antenna and a shroud member. The 5G NR antenna includes a radiating element configured to transmit radio signals at frequencies greater than 24 GHz. The shroud member comprises a polyvinyl chloride (PVC) substrate. The radiating element is configured to emit and receive radio signals through the shroud member.

30 Claims, 24 Drawing Sheets

(56) References Cited

OTHER PUBLICATIONS

¾MM Solid Polycarbonate Product Data Sheet, Storm Building Products (1 page) (Apr. 2019).
Allen 5100WMG Technical Data Sheet, Allen Thermoplastics (2 pages) (Apr. 28, 2017).
Amgard Acrylic Sheet Datasheet, Plaskolite (2 pages) (Jul. 2020).
bond-plex Waterbased Acrylic Coating Datasheet, Sherwin Williams (2 pages) (Feb. 2019).
Celtec Expanded PVC Datasheet, Curbed Plastics (1 page) (Mar. 17, 2016).
Corothane II—Hardener Polyurethane Safety Data Sheet, The Sherwin Williams Company (17 pages) (Nov. 30, 2019).
Corothane II 2K Urethane Datasheet, Sherwin Williams (4 pages) (Apr. 27, 2016).
Corothane II Polyurethane (Part A) Satin 20045 Safety Data Sheet, The Sherwin Williams Company (19 pages) (Jun. 30, 2020).
Corothane II Polyurethane (Part A) Satin 24108 Safety Data Sheet, The Sherwin Williams Company (19 pages) (Jun. 30, 2020).
Corothane II—Satin Polyurethane (Part A) Safety Data Sheet, The Sherwin Williams Company (19 pages) (Jun. 30, 2020).
Corothane II—Satin Polyurethane (Part A) Ultradeep Base Safety Data Sheet, The Sherwin Williams Company (18 pages) (May 14, 2020).
Corrtec Safety Data Sheet, Vycom Olefin and PVC Solutions (5 pages) (Dec. 20, 2013).
Duralite Technical Datasheet, Crane Composites (2 pages) (Dec. 2012).
Enhanced Stealthskin V (ESSV) Panel Information Sheet, Stealth Concealment Solutions, Inc. (1 page) (Jan. 2018).
Ertalon 66 SA, Technical Data Sheet for Nylon 66 Rod, Sheet and Tube, The Plastic Shop (1 page) (Jan. 20, 2011).
Foamed PVC Sheet Optimized for Printing and Displays Datasheet, Palight Premium, Palram Americas (2 pages) (Oct. 28, 2015).
Gepax 7000 Product Datasheet, SABIC (2 pages) (2012).
HDPE Datasheet, Curbell Plastics (1 page) (2016).
High Density Polyethylene Bapolene 2035 Blow Molding Material Safety Data Sheet, Bamberger Polymers, Inc. (Apr. 2013).
KYDEX 100 Technical Data Sheet, KYDEX Thermoplastics (2 pages) (Apr. 15, 2020).
KYDEX 510 Technical Data Sheet, KYDEX Thermoplastics (2 pages) (Mar. 13, 2020).
Lexan 9030 Product Datasheet, GE Plastics Specialty Film and Sheet (6 pages) (2005).
Lexan 9440 Product Datasheet, SABIC (2 pages) (2012).
Lexan SGC504 / SGC504DW Product Datasheet, SABIC (2 pages) (2020).
LuciteLux Cell Cast Technical Bulletin, Piedmont Plastics (1 page) (Jul. 2013).
LuciteLux Light Guide Panel LXN 875 Technical Bulletin, Piedmont Plastics (1 page) (Jan. 19, 2016).
Makrolon SL Sheet Datasheet (2 pages) (2015).
Mirrored Acrylic Sheeting Product Data Sheet, Storm Building Products (3 pages) (Dec. 2018).
Palboard Multilayered PVC Sheet Datasheet, PALRAM Industries (2 pages) (Aug. 2018).
Palight Premium Physical Properties Datasheet, PALRAM Americas (1 page) (Mar. 9, 2015).
Palsun A Family of Flat Solid PC Sheet Products Datasheet, PALRAM Americas (2 pages) (Jun. 28, 2016).
PC25 25MM Multiwall Polycarbonate Product Data Sheet, Storm Building Products (2 pages) (Mar. 2018).
PC35-SG 35MM Solarguard Polycarbonate Product Data Sheet, Storm Building Products (1 page) (Mar. 2018).
PC4 4MM Twinwall Polycarbonate Product Data Sheet, Storm Building Products (1 page) (Mar. 2018).
Plexiglas Arena Cell Cast Acrylic Sheet Datasheet, Altuglas International, Arkema Group (2 pages) (Oct. 2012).
Plexiglas Clear-Edge Frosted Acrylic Sheet Datasheet, Plexiglas by Arkema, Altuglas International, Arkema Group (2 pages) (Feb. 2013).
Plexiglas EdgeFX Acrylic Sheet Datasheet, Plexiglas by Arkema, Altuglas International, Arkema Group (2 pages) (Mar. 2013).
Plexiglas G Cell-Cast Acrylic Sheet Datasheet, Plexiglas by Arkema, Altuglas International, Arkema Group (2 pages) (Mar. 2013).
Plexiglas Sylk Acrylic Sheet Datasheet, Plexiglas by Arkema (2 pages) (Dec. 2016).
PMG Aqua-Plas I Ultra Datasheet, Piedmont Plastics (2 pages) (Jun. 13, 2019).
PMG Aqua-Plas III Ultra LG Datasheet, Piedmont Plastics (2 pages) (Jun. 13, 2019).
Polane Solar Reflective Polyurethane Enamel Chemical Coatings Datasheet, Sherwin Williams (2 pages) (Mar. 26, 2008).
Polystone ABS Technical Data Sheet, Rochling Engineering Plastics (1 page) (Apr. 12, 2016).
Prime ABS ST80 Datasheet, Primex Plastics Corporation (1 page) (May 2017).
Prime ABS Weather-X ML200 Datasheet, Primex Plastics Corporation (1 page) (May 2017).
Pultruded Fiberglass Thermoset Polyester/FR Polyester Safety Data Sheet, Bedford Reinforced Plastics, Inc. (2 pages) (Jan. 1, 2020).
Pultruded Fiberglass Thermoset Vinylester/FR Vinylester Safety Data Sheet, Bedford Reinforced Plastics, Inc. (2 pages) (Jan. 1, 2020).
PVC Corrugated Sheeting Product Data Sheet, Storm Building Products (1 page) (Mar. 2018).
Superpaint Exterior Latex Flat Datasheet, A80-Series, Sherwin Williams (2 pages) (Aug. 2020).
Superpaint Exterior Latex Flat Datasheet, Sherwin Williams (2 pages) (Nov. 2017).
Superpaint Exterior Latex Satin Datasheet, A89-Series, Sherwin Williams (2 pages) (Aug. 2020).
Sustamid 66—ASTM (PA 66 / Extruded Nylon) Technical Data Sheet, Rochling Engineering Plastics (1 page) (Nov. 6, 2018).

* cited by examiner

CONCEALMENT SYSTEMS AND WIRELESS COMMUNICATION EQUIPMENT INSTALLATIONS AND METHODS INCLUDING SAME

RELATED APPLICATION(S)

The present application claims the benefit of and priority from U.S. Provisional Patent Application No. 62/841,298, filed May 1, 2019 the disclosure of which is incorporated herein by reference in its entirety.

FIELD OF THE INVENTION

The present inventive concepts relate generally to wireless communication networks and, more particularly, to shrouds and radomes that are used as a protective cover for antennas in wireless communication networks.

BACKGROUND OF THE INVENTION

5G New Radio (NR) is the successor to 4G wireless communication systems and is designed to provide higher data rates, reduced latency, increased system capacity, and energy savings. The ITU IMT-2020 specification provides for speeds of up to 20 Gbit/s with relatively wide channel bandwidths by way of multiple-input/multiple-output techniques. The spectrum 5G NR specification has defined and sub-divided the reserved spectrum into two frequency bands: FR1 below 6 GHz and FR2 greater than 24 GHz (millimeter wave). That maximum channel bandwidth defined for FR1 is 100 MHz. The minimum channel bandwidth defined for FR2 is 50 MHz and the maximum channel bandwidth is 400 MHz.

The millimeter wave technology used to support the FR2 frequency spectrum for 5G NR systems have the advantage of providing bandwidth that is orders of magnitude of improvement over LTE systems. The shorter wave lengths used in millimeter wave technology may also allow for the use of comparatively smaller antennas. This may allow for multiple antennas tuned for different millimeter wavelengths in a single device allowing for more efficient use of the available frequency spectrum. The higher frequencies, however, result in shorter transmission ranges and the shorter wavelengths are more impacted by interference from structural impediments, such as walls, buildings, and weather. Thus, previous generation cellular systems may use relatively fewer and larger antenna towers, while 5G NR cellular systems may use many more smaller antennas positioned in various locations, such as towers, light poles, buildings, and the like, particularly in urban areas with lots of structural impediments. These antenna deployments will typically use some type of shroud or radome to provide protection from environmental hazards, such as weather, insects, animals, UV damage, and the like.

SUMMARY OF THE INVENTION

According to some embodiments, a wireless communication equipment installation for wireless communication equipment includes a 5G New Radio (NR) antenna and a shroud member. The 5G NR antenna includes a radiating element configured to transmit radio signals at frequencies greater than 24 GHz. The shroud member comprises a polyvinyl chloride (PVC) substrate. The radiating element is configured to emit and receive radio signals through the shroud member.

In some embodiments, the PVC substrate has a multilayer construction and includes a core layer having a front surface and an opposing rear surface, and a skin layer covering the front or rear surface of the core layer. The skin layer comprises a non-foamed PVC. The core layer comprises a foamed PVC. The skin layer is bonded to the front or rear surface of the core layer.

In some embodiments, the shroud member is a substantially flat panel, and the core layer and the skin layer are each substantially planar layers.

In some embodiments, the shroud member is a curved radome, and the core layer and the skin layer are each curved layers.

In some embodiments, the core layer has a thickness in the range of from about 1.4 mm to about 9.4 mm, and the skin layer has a thickness in the range of from about 0.28 mm to about 0.32 mm.

In some embodiments, the skin layer is a front skin layer covering the front surface of the core layer, the PVC substrate further includes a rear skin layer covering the rear surface of the core layer, and the rear skin layer is formed of a non-foamed PVC.

In some embodiments, reflected power between the front skin layer and the core layer is not greater than about −10 dB, and reflected power between the rear skin layer and the core layer is not greater than about −10 dB.

According to some embodiments, the wireless communication equipment installation includes a concealment system including the shroud member. The concealment system further includes a base concealment member, and an aperture defined in the base concealment member. The shroud member is mounted in or over the aperture. The concealment system is installed relative to the radiating element such that radio signals emitted from the radiating element are directed primarily through the aperture and the shroud member. The base concealment member is formed of a base material. The material of the shroud member is less attenuating of the radio signals emitted from the radiating element than the base material.

In some embodiments, the wireless communication equipment installation includes an antenna. The antenna includes the radiating element and having a front face through which the radio signals are transmitted. The concealment system further includes a rain hood covering the antenna to inhibit rain water from depositing and collecting on the front face of the antenna and/or on a rear surface of the shroud member in front of the antenna.

In some embodiments, the PVC substrate has a dielectric constant in the range of from about 2 to 6.

In some embodiments, the shroud member has an insertion loss of less than about −0.5 dB for frequencies of the radio signals in a range of about 25 GHz to about 40 GHz.

In some embodiments, a radiation pattern through the shroud member that has a half-power beamwidth angle that deviates less than two degrees relative to a half-power beamwidth angle associated with a radiation pattern generated through free space for frequencies of the radio signals in a range of about 25 GHz to about 52 GHz.

According to some embodiments, the radiating element is spaced apart from the shroud member at a distance in the range of from of about 5 mm to about 60 mm, and the antenna transmits millimeter-wave 5G radio signals at an angle of incidence of about 0° to about 60° relative to a surface of the shroud member.

In some embodiments, the PVC substrate comprises a foamed PVC layer.

In some embodiments, the PVC substrate has a thickness in the range of from about 0.5 mm to about 30 mm.

According to some embodiments, the shroud member further comprises a coating on a surface of the PVC substrate.

In some embodiments, the radiating element is configured to generate a radiation pattern through the shroud member that has a max gain of a main lobe that deviates from a max gain of a main lobe associated with a radiation pattern generated through free space by not more than about 0.5 dB.

In some embodiments, the radiating element is configured to generate a radiation pattern through the shroud member that has a half-power beamwidth angle that deviates less than one degree relative to a half-power beamwidth angle associated with a radiation pattern generated through free space.

In some embodiments, the radiating element is configured to generate the radiation pattern through the shroud member for radio signals in a frequency range of about 24 GHz to about 39 GHz or about 47 GHz.

In some embodiments, the PVC substrate has a magnetic permeability and/or an electrical permittivity that is configured to maintain reflected power at an interface of the PVC substrate with another medium to less than about −10 dB.

In some embodiments, impedance of the PVC substrate is substantially the same (e.g., within ±40 Ohms) as the impedance of free space.

According to some embodiments, a method for forming a wireless communication equipment installation includes: providing a 5G New Radio (NR) antenna including a radiating element configured to transmit radio signals at frequencies greater than 24 GHz; providing a shroud member, wherein the shroud member comprises a polyvinyl chloride (PVC) substrate; and mounting the shroud member adjacent the radiating element and in the path of radio signals emitted from the radiating element.

According to some embodiments, a wireless communication equipment installation includes wireless communication equipment and a concealment system. The wireless communication equipment includes a radiating element configured to emit radio signals. The concealment system includes a shroud member disposed adjacent the radiating element and in the path of the radio signals emitted from the radiating element. The shroud member has a multilayer construction and includes: a core layer having a front surface and an opposing rear surface; and a skin layer covering the front or rear surface of the core layer. The skin layer comprises a non-foamed polyvinyl chloride (PVC). The core layer comprises a foamed PVC. The radiating element is configured to emit and receive radio signals through the shroud member.

In some embodiments, the skin layer is a front skin layer covering the front surface of the core layer, and the shroud member further includes a rear skin layer covering the rear surface of the core layer. The rear skin layer comprises a non-foamed PVC.

In some embodiments, the wireless communication equipment and the radiating element are configured to emit the radio signals having frequencies greater than 24 GHz through the shroud member.

According to some embodiments, a method for forming a wireless communication equipment installation includes providing a concealment system including a shroud member. The shroud member has a multilayer construction and includes: a core layer having a front surface and an opposing rear surface; and a skin layer covering the front or rear surface of the core layer. The skin layer comprises a non-foamed polyvinyl chloride (PVC). The core layer comprises a foamed PVC. The method further includes mounting the shroud member adjacent a radiating element of wireless communication equipment and in the path of radio signals emitted from the radiating element.

According to some embodiments, the skin layer is a front skin layer covering the front surface of the core layer, the shroud member further includes a rear skin layer covering the rear surface of the core layer, and the rear skin layer comprises a non-foamed PVC.

In some embodiments, the method includes emitting the radio signals having frequencies greater than 24 GHz from the radiating element and through the shroud member.

According to some embodiments, a wireless communication equipment installation includes wireless communication and a concealment system. The equipment wireless communication equipment includes a radiating element configured to emit radio signals. The concealment system includes: a base concealment member; an aperture defined in the base concealment member; and a shroud member mounted in or over the aperture. The shroud member is disposed adjacent the radiating element and in the path of radio signals emitted from the radiating element. The base concealment member is formed of a first material. The shroud member is formed of a second material that is different from the first material. The second material is less attenuating of the radio signals emitted from the radiating element than the first material.

In some embodiments, the first material is stronger than the second material.

In some embodiments, the concealment system further includes a shroud mounting system securing the shroud member to the base concealment member.

According to some embodiments, the shroud mounting system includes a frame, the frame is secured to the base concealment member adjacent the aperture, and the shroud member is mounted on the frame.

According to some embodiments, the base concealment member and the shroud member are each substantially flat panels.

In some embodiments, the wireless communication equipment and the radiating element are configured to emit radio signals having frequencies greater than 24 GHz through the shroud member.

According to some embodiments, a concealment system for wireless communication equipment including a radiating element includes a base concealment member, an aperture defined in the base concealment member, and a shroud member mounted in or over the aperture. The concealment system is configured to be installed relative to the radiating element such that radio signals emitted from the radiating element are directed primarily through the aperture and the shroud member. The base concealment member is formed of a first material. The shroud member is formed of a second material that is different from the first material. The second material is less attenuating of the radio signals emitted from the radiating element than the first material.

According to some embodiments, a method for forming a wireless communication equipment installation includes providing a concealment system including: a base concealment member; an aperture defined in the base concealment member; and a shroud member mounted in or over the aperture. The method further includes installing the concealment system such that the shroud member is disposed adjacent the radiating element and in the path of radio signals emitted from the radiating element. The base concealment member is formed of a first material. The shroud member is formed of a second material that is different from the first material. The second material is less attenuating of the radio signals emitted from the radiating element than the first material.

In some embodiments, the method includes retro-fitting the concealment system onto a concealment member already in service, including: forming the aperture in the base concealment member; and securing the shroud member in or over the aperture.

In some embodiments, the method includes emitting radio signals having frequencies greater than 24 GHz from the radiating element and through the shroud member.

DETAILED DESCRIPTION OF EMBODIMENTS OF THE INVENTION

Figure 1A:
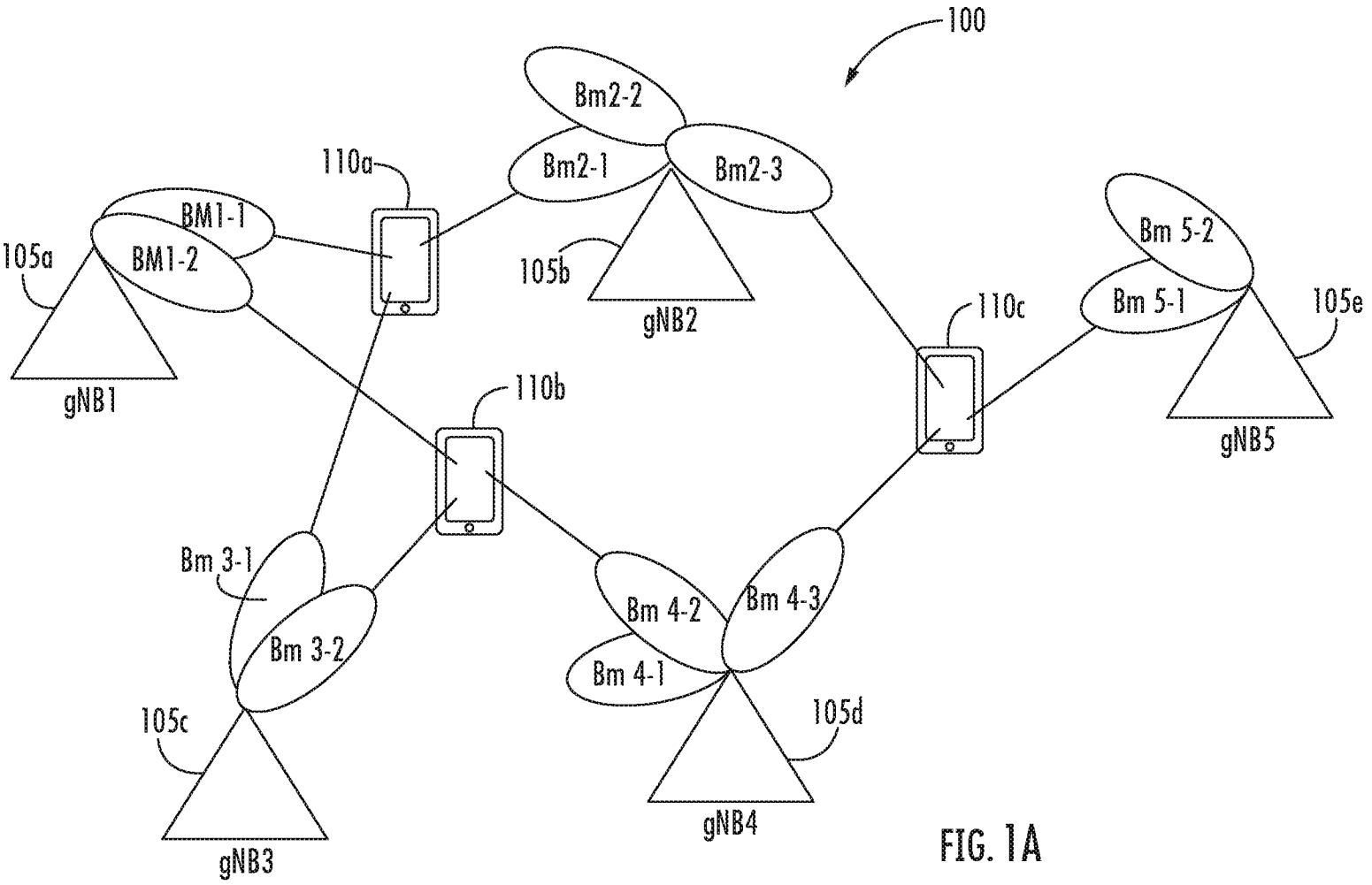
FIG. 1A is a block diagram of a wireless communication network including base stations that support multibeam operation according to some embodiments.

In the following detailed description, numerous specific details are set forth to provide a thorough understanding of embodiments of the present disclosure. However, it will be understood by those skilled in the art that the present invention may be practiced without these specific details. In some instances, well-known methods, procedures, components and circuits have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

As used herein, "monolithic" means an object that is a single, unitary piece formed or composed of a material without joints or seams.

As used herein, "millimeter-wave 5G" and "mm-wave 5G" refer to an apparatus that is configured to and operated to transmit RF signals in the frequency range of 24 GHz and greater. The millimeter-wave band extends all the way up to 300 GHz, but it is the frequency range from 24 GHz up to 100 GHz that is expected to be used for 5G. The millimeter-wave 5G apparatus may be a base station, an RF radio, or an antenna, for example.

Embodiments of the inventions are directed to shroud members for forming enclosures or structures, barriers or shields to hide, conceal, and/or protect an RF electromagnetic signal antenna. In particular, embodiments of the inventions are directed to such shroud members for forming enclosures or structures, barriers or shields to hide, conceal, and/or protect a millimeter-wave 5G RF electromagnetic signal antenna. In some embodiments, the shroud member constitutes a shroud or radome. In some embodiments, the shroud member forms a part of a shroud or radome including additional components. In some embodiments, the shroud member forms a part of a wireless communication equipment installation or concealment system according to embodiments of the invention.

The shroud members may be constructed to minimally attenuate the electromagnetic signals transmitted (emitted and/or received) by the antenna. In particular, in some embodiments, the shroud member is constructed to minimally attenuate millimeter-wave 5G RF electromagnetic signals transmitted by a millimeter-wave 5G RF electromagnetic signal antenna shrouded by the shroud member.

In some embodiments, the shroud member is a unitary or monolithic structure including multiple layers. However, in some embodiments, the shroud member is a single layer structure.

In 5G New Radio (NR) networks, both a base-station, e.g., gNB, and a UE can be configured to support multibeam operation. For example, the synchronization signal block (SSB) in NR may be configured to operate with up to 256 narrowbeams. This number may increase in future networks as antenna and/or radio signal processing technology evolve. Depending on the purposes (e.g., initial access, broadcast transmissions), beams are typically transmitted using a beam sweep in to cover a portion or an entire cell, where the beams are transmitted consecutively in time.

Figure 1B:
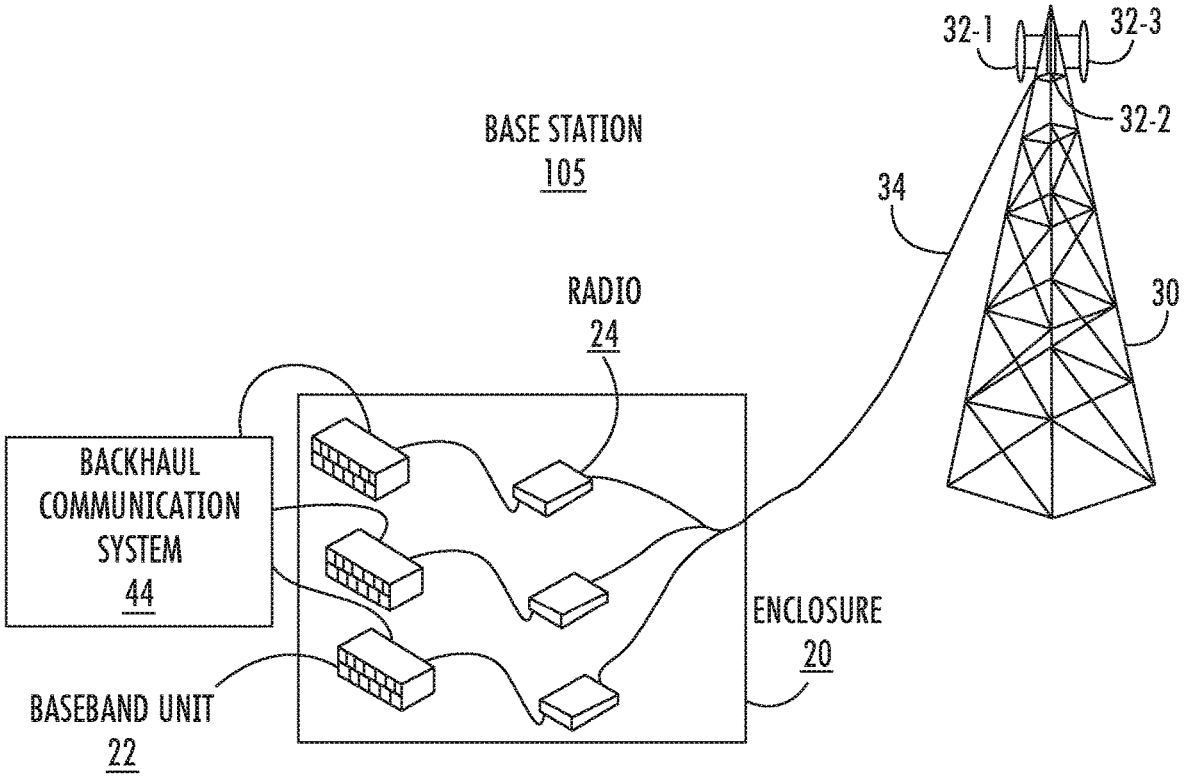
FIG. 1B is a block diagram that illustrates an architecture of a base station used in the wireless communication network of FIG. 1A according to some embodiments.

FIG. 1A is a block diagram of a wireless communication network 100 including base stations that support multibeam operation according to some embodiments of the inventive concept. The wireless communication network 100 includes five 5G NR base stations gNB1 105*a*, gNB2 105*b*, gNB3 105*c*, gNB4 105*d* and gNB5 105*e* that are configured for multiple beam operation. The architecture of the 5G NR base stations gNB1 105*a*, gNB2 105*b*, gNB3 105*c*, gNB4 105*d* and gNB5 105*e*, according to some embodiments of the inventive concept, is illustrated in FIG. 1B. A base station 105, which may be used to implement each of the 5G NR base stations gNB1 105*a*, gNB2 105*b*, gNB3 105*c*, gNB4 105*d* and gNB5 105*e*, may include an antenna tower 30 and an equipment enclosure 20 that is located at the base of the antenna tower 30. A plurality of baseband units 22 and radios 24 may be located within the equipment enclosure 20. Each baseband unit 22 may be connected to a respective one of the radios 24 and may also be in communication with a backhaul communications system 44. One or more antennas 32-2, 32-2, and 32-3 may be located at the top of the antenna tower 30. Coaxial cables 34 may be used to connect the radios 24 to the respective antennas 32-2, 32-2, and 32-3. Each end of each coaxial cable 34 may be connected to a duplexer so that both the transmit and receive signals for each radio 24 may be carried on a single coaxial cable 34. In some implementations the radios 24 may be located at the top of the tower 30 instead of in the equipment enclosure 20 to reduce signal transmission losses.

Each antenna 32-2, 32-2, and 32-3 may comprise an array of radiating elements. Each radiating element may be used to transmit radio frequency ("RF") signals that are received from a transmit port of an associated radio and to receive RF signals from mobile users and pass such received signals to the receive port of the associated radio 24. Duplexers are typically used to connect the radio 24 to each respective radiating element of the antenna 32-2, 32-2, and 32-3. A "duplexer" may be a three-port filter assembly that is used to connect both the transmit and receive ports of a radio 24 to an antenna 32-2, 32-2, and 32-3 or to a radiating element of a multi-element antenna 32-2, 32-2, and 32-3. Duplexers may be used to isolate the RF transmission paths to the transmit and receive ports of the radio from each other while allowing both RF transmission paths access to the radiating elements of the antenna 32-2, 32-2, and 32-3.

While the example base station 105 illustrates antennas 32-2, 32-2, and 32-3 located at the top of a tower 30 with radios located in an enclosure 20, it will be understood that the locales of these elements and other elements comprising the base station 105 may vary in accordance with different embodiments of the inventive concept. For example, the antennas 32-2, 32-2, and 32-3 may be located in or on other structures, such as buildings, bridges, and the like, and may be co-located with other components, such as the radios 24, to form a wireless equipment installation in or on structures that may have other purposes or uses.

In some embodiments, the base stations gNB1 105*a*, gNB2 105*b*, gNB3 105*c*, gNB4 105*d* and gNB5 105*e* may be configured to generate a plurality of directional beams that are transmitted at different azimuth angles. Each base station gNB1 105*a*, gNB2 105*b*, gNB3 105*c*, gNB4 105*d* and gNB5 105*e* may be configured to transmit a maximum number of different directional beams, such as, for example, 256 beams total in some embodiments. In addition, each base station gNB1 105*a*, gNB2 105*b*, gNB3 105*c*, gNB4 105*d* and gNB5 105*e* may be configured to use less than the maximum number of different directional beams that are configurable for operation. For example, a base station gNB1 105*a*, gNB2 105*b*, gNB3 105*c*, gNB4 105*d* and gNB5 105*e* may be capable of using 64 different directional beams, but may use only 16 directional beams because of a lack of need to transmit in certain geographic directions. Each base station gNB1 105*a*, gNB2 105*b*, gNB3 105*c*, gNB4 105*d* and gNB5 105*e* may allocate one or more sub-frequencies and time segments for transmitting and/or receiving on each beam. Each beam is separated in time and a full cycle from the first active beam to the last active beam may be called a beam sweep.

The base stations gNB1 105*a*, gNB2 105*b*, gNB3 105*c*, gNB4 105*d* and gNB5 105*e* may transmit a Positioning Reference Signals (PRS) on each of the beams for use in determining the positions of a User Equipment (UE). To ensure that the UE can receive the PRS transmissions, a schedule may be generated for each of the base stations gNB1 105*a*, gNB2 105*b*, gNB3 105*c*, gNB4 105*d* and gNB5 105*e*. Referring to FIG. 1, base station gNB1 105*a* transmits PRSs on beams Bm1-1 and Bmf-2, which are received by UEs 110*a* and 110*b*, respectively. Base station gNB2 105*b* transmits PRSs on beams Bm2-1, Bm2-2, which are received by UEs 110*a* and 110*c*, respectively. Base station gNB2 105*b* also transmits a PRS on beam Bm2-2. Base station gNB3 105*c* transmits PRSs on beams Bm3-1 and Bm3-2, which are received by UEs 110*a* and 110*b*, respectively. Base station gNB4 105*d* transmits PRSs on beams Bm4-2 and Bm4-3, which are received by UEs 110*b* and 110*c*, respectively. Base station gNB4 105*d* also transmits a PRS on beam Bm4-1. Base station gNB5 105*e* transmits a PRS on Bm5-1, which is received by UE 110*c*. Base station gNB5 105*e* also transmits a PRS on beam Bm5-2. Although each base station gNB1 105*a*, gNB2 105*b*, gNB3 105*c*, gNB4 105*d* and gNB5 105*e* is shown as only transmitting a PRS on two or three beams in FIG. 1, it will be understood that the base stations gNB1 105*a*, gNB2 105*b*, gNB3 105*c*, gNB4 105*d* and gNB5 105*e* may transmit a PRS on more or fewer beams in accordance with various embodiments of the inventive concept. Interference among beams within the serving cell or neighbor cells may be mitigated according to some embodiments. In connected mode, a UE is communicating to a serving cell but may still listen to neighbor cells for measurement. For example, referring to FIG. 1, the serving base station for UE 110*a* may be the first base-station (105*a*). The first base-station (105*a*) may be configured to use beam Bm1-1 while the second base-station (105*b*) may use beam Bm2-2. Such scheduling reduces interference among beams within the serving cell and/or the neighbor cell. Thus, a UE 110*a*, 110*b*, 110*c* may communicate with a serving cell gNB1 105*a*, gNB2 105*b*, gNB3 105*c*, gNB4 105*d* and gNB5 105*e* using one or more of the beams transmitted therefrom while also listening to other neighboring cells for UE location functionality as well as handover operations when a UE 110*a*, 110*b*, 110*c* moves from one serving cell to another serving cell gNB1 105*a*, gNB2 105*b*, gNB3 105*c*, gNB4 105*d* and gNB5 105*e*.

Each of the serving base stations gNB1 105*a*, gNB2 105*b*, gNB3 105*c*, gNB4 105*d* and gNB5 105*e* of FIG. 1A may be installed with some type of shroud member used to provide environmental protection for the antenna. Such radomes may take a variety of different shapes depending on the application as described herein. For example, a shroud member may be generally planar shaped for an antenna installation on a building in which the antennas are configured to transmit radio signal beams in a relatively limited azimuth angle range. Conversely, a shroud member may be generally cylindrical shaped for an antenna that is configured to transmit radio signal beams across a full 360 degree azimuth angle range. Regardless of the particular shape of the shroud member used to provide environmental protection for the antenna, it is generally desirable for the shroud member to provide low insertion loss so as to reduce the amount of radio signal beam energy that is absorbed or reflected back by the shroud member.

Figure 2:
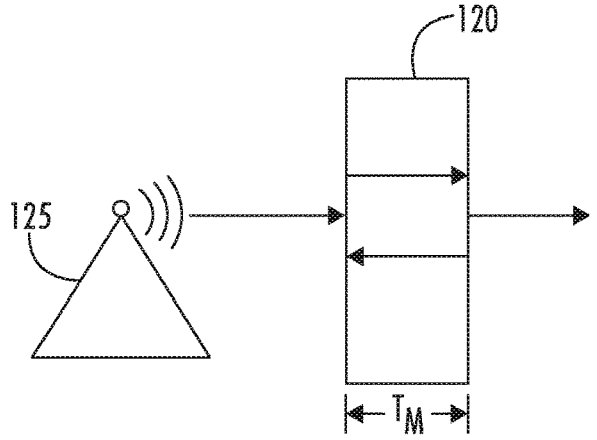
FIG. 2 is a block diagram that illustrates a shroud member comprising a single dielectric material according to some embodiments.

FIG. 2 illustrates a shroud member comprising a single dielectric material according to some embodiments of the inventive concept. As shown in FIG. 2, a base station 125 may transmit radio signals through the shroud member 120 for receipt by one or more UEs. Because of the difference in characteristic impedance between free space and the material comprising the shroud member 120, however, some of portion of the radio signal is reflected and some portion of the radio signal is transmitted through the shroud member 120. In general, a low dielectric constant material reduces reflections, which reduces the impact on the radiation pattern and insertion loss of the shroud member 120. Besides electrical performance, other characteristics may be considered, such as strength, operating temperature, cost, and the like, when choosing a dielectric material. Thus, it may not always be practical to choose the lowest dielectric material for use in the shroud member 120. The reflection coefficient when an electromagnetic wave transitions from one material to another material is given by Equation 1:

$$\Gamma=(Z1-Z2)/(Z1+Z2) \qquad \text{EQ. 1}$$

The impedance of free space is 377Ω. Thus, if Z1 is the impedance of the dielectric material of the shroud member 120 of FIG. 2, which is typically less than the impedance of free space (Z2), then the reflection coefficient F is negative, which means the reflected wave is 180 degrees out of phase with the incident wave. When the wave reaches the free space boundary on the exit side of the shroud member 120, the numerator reverses resulting in as reflected wave that is again 180 degrees out of phase. Thus, for a shroud member 120 comprising a single dielectric material, the thickness T of the material may be some multiple of ½ the radio signal wavelength. This allows the reflections to cancel out within the shroud or radome 120. The radio signal wave travels 180 degrees through the dielectric material, is reflected with a phase shift of −180 degrees and travels another 180 degrees on the return trip to achieve the net 180 degree phase shift for cancellation.

Thus, according to some embodiments of the inventive concept, the thickness of a monolithic dielectric material used in a shroud member 120 may be approximately an integer number n multiple of one-half the wavelength of the radio signal in the dielectric material. This may be given by Equation 2 below:

$$T_m=n^*\lambda_m/2 \qquad \text{EQ. 2}$$

The wavelength of the radio signal in free space is equal to the speed of light divided by the frequency as set forth in Equation 3:

$$\lambda_0=c_0/f_c,\ c_0 \text{ is the speed of light and } f_c \text{ is the radio signal frequency in free space.} \qquad \text{EQ. 3}$$

The wavelength of the radio signal in the dielectric material $\lambda_m$ is related to the wavelength of the radio signal in free space $\lambda_0$ by Equation 4:

$\lambda_m=\lambda_0/\text{SQRT}\ \varepsilon_r$ where SQRT is the square root and $E_r$ is the relative permittivity of the dielectric material 120, e.g., the dielectric constant of the dielectric material.

Thus, given the radio signal frequency and the dielectric constant of the dielectric material in the shroud member 120, a thickness $T_m$ for the dielectric material 120 may be determined to reduce insertion loss and improve performance of the base station antenna system.

Figure 3:
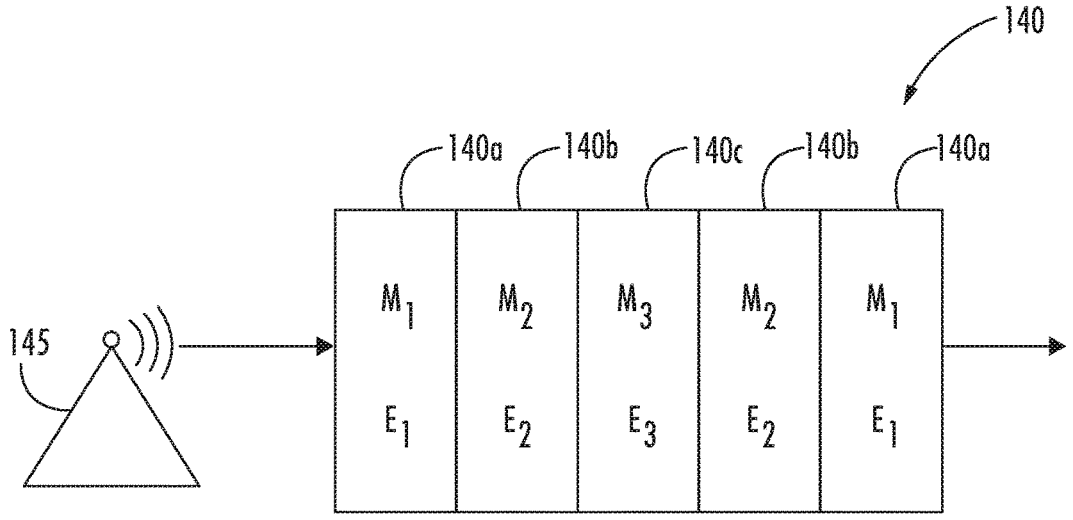
FIG. 3 is a block diagram that illustrates an A-sandwich shroud member according to some embodiments.

In some embodiments, the dielectric material used to form a shroud member may be reinforced with additional laminate materials to improve the structural integrity of the shroud member. This configuration may be called the A-sandwich shroud member configuration. FIG. 3 illustrates an A-sandwich shroud member according to some embodiments of the inventive concept. As shown in FIG. 3, a base station 135 may transmit radio signals through the shroud member 130 for receipt by one or more UEs. The shroud member 130 comprises two outer layers 130*a* and 130*b* with a third material 130*c* between the two outer layers 130*a* and 130*b*. Operation of the A-sandwich shroud member configuration is similar to that of the monolithic dielectric material radome configuration of FIG. 2 with the exception that the thickness of the inner third material 130*c* may be approximately an integer number n multiple of one-quarter the wavelength of the radio signal in the dielectric material. This may be given by Equation 5 below:

$$T_m=n^*\lambda_m/4 \qquad \text{EQ. 2}$$

This is because the reflection coefficients from the outer layers 130*a* and 130*b* have the same amplitude and phase. Thus, given the radio signal frequency and the dielectric constant of the dielectric material 130*c* in the shroud member 130, a thickness $T_m$ for the dielectric material 130*c* may be determined to reduce insertion loss and improve performance of the base station antenna system.

In accordance with some embodiments of the inventive concept, a radome 130 used in a 5G NR base station antenna installation in which the base station operates in the millimeter-wave 5G frequency range (i.e., equal to or greater than 24 GHz), in a frequency range of 24 GHz to about 52 GHz and, in some embodiments, about 39 GHz to about 47 GHz, and may use a dielectric material 130*c* comprising a PVC foamed sheet, which has a dielectric constant of about 2 to about 6. A thickness $T_m$ of the dielectric material 130*c* may be in a range of about 0.5 mm to about 30 mm or in some embodiments about 2 mm to about 10 mm. In some embodiments, the thickness $T_m$ of the dielectric material 130*c* is in a range of about 0.5 mm to about 30 mm.

Figure 4:
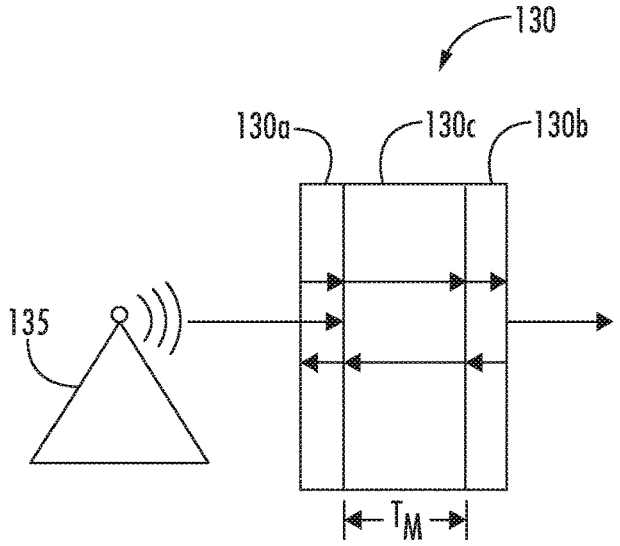
FIG. 4 is a block diagram that illustrates a multiple medium shroud member according to some embodiments.

The embodiments of FIGS. 2 and 3 described above may reduce insertion loss of a shroud member by adjusting the thickness of a dielectric core material based on the frequency of the radio signal and core material dielectric constant. FIG. 4 illustrates a shroud member comprising multiple layers of materials that are impedance matched to reduce insertion loss. As shown in FIG. 4, a base station 145 may transmit radio signals through the shroud member 140 for receipt by one or more UEs. According to some embodiments of the inventive concept, a shroud member 140 may be viewed as a succession of one or more mediums through which a radio signal may traverse. The intrinsic impedance of a medium, assuming an ideal dielectric where the conductivity is assumed to be zero, is based on the magnetic permeability and the electrical permittivity. Specifically, the impedance of a medium may be expressed as Equation 6 below:

$Z$=SQRT($\mu/\varepsilon$) where SQRT is the square root, $\mu$ is the magnetic permeability of the medium and $\varepsilon$ is the electrical permittivity of the medium EQ. 6

Recall, however, from EQ. 1 above, that to minimize the reflection coefficient between two adjacent mediums, their impedances should be equal to each other. Using the example shroud member 140 configuration of FIG. 4 in which an A-sandwich structure is used with free space represented as medium 140*a* and the shroud member structure 140 including two outer layers 140*b* and an inner layer 140*c* therebetween, the relationship between free space 140*a* and the outer layers 140*b* may be expressed as Equation 7 below when the impedances between free space 140*a* and the outer layers 140*b* match each other:

$$\mu_1\varepsilon_2=\mu_2\varepsilon_1 \quad \text{EQ. 7}$$

Similarly, the relationship between the outer layers 140*b* and the inner layer 140*c* may be expressed as Equation 8 below when the impedances between the outer layers 140*b* and the inner layer 140*c* match each other:

$$\mu_2\varepsilon_3=\mu_3\varepsilon_2 \quad \text{EQ. 8}$$

Thus, in some embodiments of the inventive concept, a shroud member structure may be include one or more layers of materials such that the electromagnetic characteristics, i.e., the magnetic permeability and the electrical permittivity, are selected for adjoining materials to match or approximately match impedance characteristics of the medium. It will be understood that although FIG. 4 illustrates an example of impedance matching in a shroud member embodiment 140 based on an A-sandwich shroud member configuration, it will be understood that a shroud member comprising a single monolithic dielectric material may be used or a plurality of layers at least some of which have different electromagnetic characteristics may be used in accordance with different embodiments of the inventive concept.

In accordance with some embodiments of the inventive concept, a radome 140 used in a 5G NR base station antenna installation in which the base station operates in a frequency range of about 25 GHz to about 52 GHz may use a dielectric material for the outer layers 140*b* and a dielectric material for the core layer 140*c* that each have magnetic permeability and electrical permittivity characteristics configured to reduce reflected energy at the interface of the layers. As described above, a perfect match between the impedance of the core layer 140*c* and the outer layers 140*b* results in a reflection coefficient of zero. In some embodiments of the inventive concept, the reflection coefficient between the core layer 140*c* and the outer layers 140*b* may result in reflected power at the interface of the core layer 140*c* with the outer layers 140*b* of not greater than −10 db (i.e., reflected power between the front outer layer 140*b* and the core layer 140*c* is not greater than about −10 dB, and reflected power between the rear outer layer 140*b* and the core layer 140*c* is not greater than about −10 dB). In some embodiments, an insertion loss associated with the shroud member structure may be less than about −0.5 dB when the base station operates in a frequency range of about 25 GHz to about 40 GHz.

In other embodiments of the inventive concept, the radio signals transmitted from a base station may be characterized by a radiation pattern. In some embodiments, when a 5G NR base station gNodeB transmits radio signals through a shroud member, such as the A-sandwich shroud member configuration 130 shown in FIG. 3, the radiation pattern for radio signal transmissions in a frequency range of about 25 GHz to about 52 GHz may have a half-power beamwidth angle that deviates less than about 2° in some embodiments and less than about 1° in other embodiments relative to the half-power beamwidth angle generated for a radiation pattern through free space without the shroud member 130 and may have a max gain of a main lobe that deviates from a max gain of a main lobe generated for the radiation pattern through free space without the shroud member 130 by less than about 0.5 dB, in some embodiments by less than about 0.4 dB, and in some embodiments, by about 0.1 dB to about 0.2 dB.

According to some embodiments, a shroud member of the present invention and as disclosed herein comprises a polyvinyl chloride (PVC) substrate. In some embodiments, the PVC substrate alone is the shroud member (i.e., the shroud member itself does not include any additional components or layers). As used herein, "a PVC substrate" or "the PVC substrate" refers to the PVC substrate forming a shroud member (in whole or in part) of the present invention.

Optionally, the shroud member includes a coating (e.g., a film or paint) on a surface of the shroud member, optionally on a surface of the PVC substrate. In some embodiments, a shroud member of the present invention is a PVC substrate that optionally comprises a coating on a surface of the PVC substrate. In some embodiments, a coating is present on at least one surface of a shroud member, optionally wherein the coating is on a surface of the shroud member that is farthest from radiating element of the antenna when installed. The coating may increase the weatherability and/or UV resistance of the shroud member. In some embodiments, the coating comprises a paint such as an acrylic and/or urethane paint.

It will be understood that, in accordance with some embodiments, the PVC substrate may be used alone, without any optional coating or layer supported by the PVC substrate.

The PVC substrate may be unitary. The PVC substrate may comprise one or more (e.g., 1, 2, 3, 4, 5, or more) layers. When the PVC substrate comprises two or more layers, a layer in the PVC substrate may be the same as or different than (e.g., in chemical composition and/or form) another layer in the PVC substrate with at least one layer in the substrate comprising PVC. In some embodiments, the PVC substrate consists of a single layer, which may be a homogeneous material and/or monolithic. In some embodiments, the PVC substrate comprises at least two layers, which may be the same as or different (e.g., have one or more different physical properties) than each other. For example, the PVC substrate may include a first layer comprising a foamed PVC layer and a second layer comprising a PVC sheet, and a surface of the foamed PVC layer may be facing and/or in contact with a surface of the PVC sheet. An adhesive, glue, and/or film may be present between the surfaces of two adjacent layers of a PVC substrate, and the adhesive, glue and/or film may be provided in a continuous pattern or discontinuous pattern between the two layers. In some embodiments, a PVC substrate comprises at least three layers, which may be the same as or different than each other. For example, the PVC substrate may include a first PVC sheet, a foamed PVC layer, and a second PVC sheet, and the foamed PVC layer may be between the first and second PVC sheets.

A "foamed PVC layer" or "PVC foam" or "foamed PVC" as used herein each refer to a foam comprising PVC. In some embodiments, a foamed PVC layer is in the form of a sheet. A foamed PVC layer may be a closed-cell PVC foam and/or an open-cell PVC foam. A foamed PVC layer may have at least one smooth surface. A surface of a foamed PVC layer may be planar. In some embodiments, a foamed PVC layer is curved or arcuate in shape (e.g., semi-cylindrical). In some embodiments, a foamed PVC layer is in tubular form. A foamed PVC layer may be shapeable and/or may be shaped. A foamed PVC layer may have a density of about 0.4 g/cm$^3$ to about 0.9 g/cm$^3$ or about 0.45, 0.5, or 0.55 g/cm$^3$ to about 0.6, 0.65, or 0.7 g/cm$^3$, optionally as measured in accordance with ASTM D-792. In some embodiments, a foamed PVC layer has a density of about 0.4, 0.45, 0.5, 0.55, 0.6, 0.65, 0.7, 0.75, 0.8, 0.85, or 0.9 g/cm$^3$, optionally as measured in accordance with ASTM D-792. A foamed PVC layer may have a thickness of about 0.25 mm to about 30 mm, about 1 mm to about 3 mm, or about 1 to about 5 or 10 mm. In some embodiments, a foamed PVC layer has a thickness of about 0.25, 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 mm. A foamed PVC layer may have a flexural strength at yield of about 20 MPa to about 35 MPa as measured in accordance with ATSM D-790. In some embodiments, a foamed PVC layer having a thickness of about 3 mm has a flexural strength at yield of about 28 MPa as measured in accordance with ATSM D-790. A foamed PVC layer may have a surface resistance of about $3\times10^{15}$ Ohms to about $7\times10^{15}$ Ohms or about $4\times10^{15}$ Ohms to about $6\times10^{15}$ Ohms, optionally as measured in accordance with ASTM D-257.

A "PVC sheet" as used herein refers to a solid PVC layer that is not foamed. A PVC sheet may also be referred to herein as a non-foamed PVC layer. In some embodiments, a PVC sheet is a layer formed from an extruded PVC composition without foaming. A PVC sheet may have at least one smooth surface. The term "PVC sheet" as used herein does not require that the PVC be in planar form. Instead, a PVC sheet may be in any suitable form and/or may be shapeable or shaped. In some embodiments, a surface of a PVC sheet may be planar. In some embodiments, a foamed PVC layer is curved or arcuate in shape (e.g., semi-cylindrical). In some embodiments, a PVC sheet is in tubular form. In some embodiments, a PVC sheet may be a shaped PVC sheet in which at least a portion of the PVC is modified such as curved or molded (e.g., using hot molding and/or cold molding). A PVC sheet may have a density of about 1 g/cm$^3$ to about 2 or 3 g/cm$^3$, optionally as measured in accordance with ASTM D-792. In some embodiments, a PVC sheet has a density of about 1, 1.5, 2, 2.5, or 3 g/cm$^3$, optionally as measured in accordance with ASTM D-792. A PVC sheet may have a thickness of about 0.1 mm to about 30 mm, about 0.3 mm to about 3 mm, or about 0.5 or 1 mm to about 5 or 10 mm. In some embodiments, a PVC sheet has a thickness of about 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 mm. A PVC sheet may have a flexural strength at yield of about 50 MPa to about 150 MPa, about 75 MPa to about 125 MPa, or about 95 MPa to 110 MPa as measured in accordance with ATSM D-790. In some embodiments, a PVC sheet having a thickness of about 1, 2, or 3 mm has a flexural strength at yield of about 103 MPa as measured in accordance with ATSM D-790.

In some embodiments, the PVC substrate or shroud member is a multilayer unit including a core that is a foamed PVC layer and a skin layer that is a non-foamed PVC layer, the foamed PVC core layer has a density in the range of from about 0.5 g/cm$^3$ to about 0.6 g/cm$^3$, and the non-foamed PVC skin layer has a density in the range of from about 1 g/cm$^3$ to about 2 g/cm$^3$.

In some embodiments, a PVC substrate and/or shroud member has a dielectric constant of about 2 to about 6, about 3 to about 5, or about 3 to about 4. In some embodiments, a PVC substrate and/or shroud member has a dielectric constant of about 2, 2.5, 3, 3.5, 4, 4.5, 5, 5.5, or 6.

According to some embodiments, impedance of a PVC substrate and/or shroud member may be substantially the same (e.g., within ±40 Ohms) as the impedance of free space.

Insertion loss of a PVC substrate and/or shroud member may be less than about 0.5, 0.4, 0.3, or 0.2 decibels, optionally wherein the insertion loss is measured at a frequency of about 28 GHz or about 39 GHz. Insertion loss for a PVC substrate and/or shroud member may be measured at incident angle of about −30° to about +30°, about −15° to about +15°, or about −5° to about +5°. In some embodiments, insertion loss for a PVC substrate and/or shroud member is measured at incident angle of about −30°, −25°, −20°, −15°, −10°, −5°, 0°, +5°, +10°, +15°, +20°, +25°, or +30°.

In some embodiments, a PVC substrate has at least one smooth and/or uniform surface. In some embodiments, a PVC substrate has at least one textured surface. A PVC substrate may be chemical and/or fire resistant. In some embodiments, a PVC substrate is self-extinguishing and/or has a classification of B, s2 and/or d0 as defined by European Standard EN 13501 and/or a classification of V-0 in accordance with UL 94 entitled "Standard for Tests for Flammability of Plastic Materials for Parts in Devices and Appliances". In some embodiments, a PVC substrate complies with ASTM E84-18 entitled "Standard Test Method for Surface Burning Characteristics of Materials." A PVC substrate (e.g., a multilayered PVC substrate comprising a first PVC sheet, a foamed PVC layer, and a second PVC sheet and the PVC substrate having a thickness of about 3 mm) may have a flame spread of 4, a flame spread index of 5, an area beneath a smoke developed curve of about 433, and/or a smoke developed index of 450 as measured in accordance with ASTM E84-18. A PVC substrate may be thermoformable. A PVC substrate or a surface thereof may be any suitable color such as, white, black, grey, red, blue, yellow, purple, green, etc. and/or any combination thereof. In some embodiments, a PVC substrate is translucent, opaque, or transparent.

A PVC substrate or a portion thereof may be in planar form or in the form of a substantially flat panel. In some embodiments, a PVC substrate or a portion thereof is shaped such that at least a portion is not in planar form. A PVC substrate may be shaped using any suitable method known in the art such as hot molding and/or cold molding. In some embodiments, a shaped PVC substrate may be tubular and/or curved. In some embodiments, a shaped PVC substrate may comprise a portion that is in the form of a hemisphere or semi-cylinder.

A shroud member may be positioned such that a surface of the PVC substrate is within a given distance of a radiating element. In some embodiments, the surface of the PVC substrate facing a radiating element (i.e., the surface of the PVC substrate that is closest to the radiating element) is about 5, 10, 20, or 30 mm to about 40, 50, or 60 mm from the radiating element, optionally with the radiating element transmitting at an angle of incidence of about 0° to about 60° relative to a surface of the shroud member and/or to the surface of the PVC substrate. In some embodiments, the surface of the PVC substrate facing the radiating element is about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 mm from the radiating element, optionally with the radiating element transmitting at an angle of incidence of about 0° to about 60° relative to a surface of the shroud member and/or to the surface of the PVC substrate. In some embodiments, the angle of incidence is about 0°, 10°, 20°, 30°, 40°, 50°, or 60°. In some embodiments, when the radiating element is transmitting a radio signal at a frequency of about 28 GHz, the surface of the PVC substrate facing the radiating element is about 10, 15, 20, 25, or 30 mm to about 40, 45, 50, 55, or 60 mm from the radiating element. In some embodiments, when the radiating element is transmitting a radio signal at a frequency of about 28 GHz, the surface of the PVC substrate facing the radiating element is at least about 0.4, 0.5, 1, 2, 3, 4, 5, 6, 7, 8, 9, 10, 11, or 12 inches from the radiating element. In some embodiments, when the radiating element is transmitting a radio signal at a frequency of about 38 GHz, the surface of the PVC substrate facing the radiating element is about 30, 35, 40, or 45 mm to about 50, 55, or 60 mm from the radiating element. In some embodiments, when the radiating element is transmitting a radio signal at a frequency of about 38 GHz, the surface of the PVC substrate facing the radiating element is at least about 1.2, 1.5, 2, 3, 4, 5, 6, 7, 8, 9, 10, 11, or 12 inches from the radiating element.

A shroud member and/or PVC substrate may have a total thickness of about 0.5 mm to about 30 mm, about 1 mm to about 3 mm, or about 1 to about 5 or 10 mm. In some embodiments, a shroud member and/or PVC substrate has a thickness of about 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 mm. A shroud member and/or PVC substrate may have a length and/or width to conceal a radiating element. In some embodiments, a shroud member and/or PVC substrate has a length of about 5, 10, 20, 30, 40, or 50 inches to about 60, 70, 80, 90, 100, 110, or 120 inches and/or a width of about 1, 5, 10, 20, or 30 inches to about 40, 50, 60, 70, or 80 inches.

A PVC substrate having a multilayer construction may comprise a first PVC sheet, a foamed PVC layer, and a second PVC sheet with the foamed PVC layer between the first and second PVC sheets. A PVC substrate having a multilayer construction may have a density of about 0.4 g/cm$^3$ to about 0.9 g/cm$^3$ or about 0.58 g/cm$^3$ to about 0.62 g/cm$^3$, optionally as measured in accordance with ASTM D-792. In some embodiments, a PVC substrate having a multilayer construction has a density of about 0.4, 0.45, 0.5, 0.55, 0.6, 0.65, 0.7, 0.75, 0.8, 0.85, or 0.9 g/cm$^3$, optionally as measured in accordance with ASTM D-792. A PVC substrate having a multilayer construction may have a thickness of about 0.25 mm to about 30 mm, about 1 mm to about 3 mm, or about 1 to about 5 or 10 mm. In some embodiments, a PVC substrate having a multilayer construction has a thickness of about 0.25, 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 mm. A PVC substrate having a multilayer construction may have a flexural modulus of about 1200 MPa to about 2000 MPa, about 1400 MPa to about 1800 MPa, or about 1500 MPa to about 1700 MPa as measured in accordance with ATSM D-790. In some embodiments, a PVC substrate having a multilayer construction and a thickness of about 3 mm has a flexural modulus of about 1600 MPa as measured in accordance with ATSM D-790. A PVC substrate having a multilayer construction may have a Shore D hardness of about 40 to about 80 or about 50 to about 70, optionally as measured in accordance with ASTM D-2240. In some embodiments, a PVC substrate having a multilayer construction has a Shore D hardness of about 40, 50, 60, 70, or 80, optionally as measured in accordance with ASTM D-2240. A PVC substrate having a multilayer construction may have a surface resistance of about $3\times10^{14}$ Ohms to about $5\times10^{14}$ Ohms or about $3.5\times10^{14}$ Ohms to about $4.5\times10^{14}$ Ohms, optionally as measured in accordance with ASTM D-257.

Figure 5:
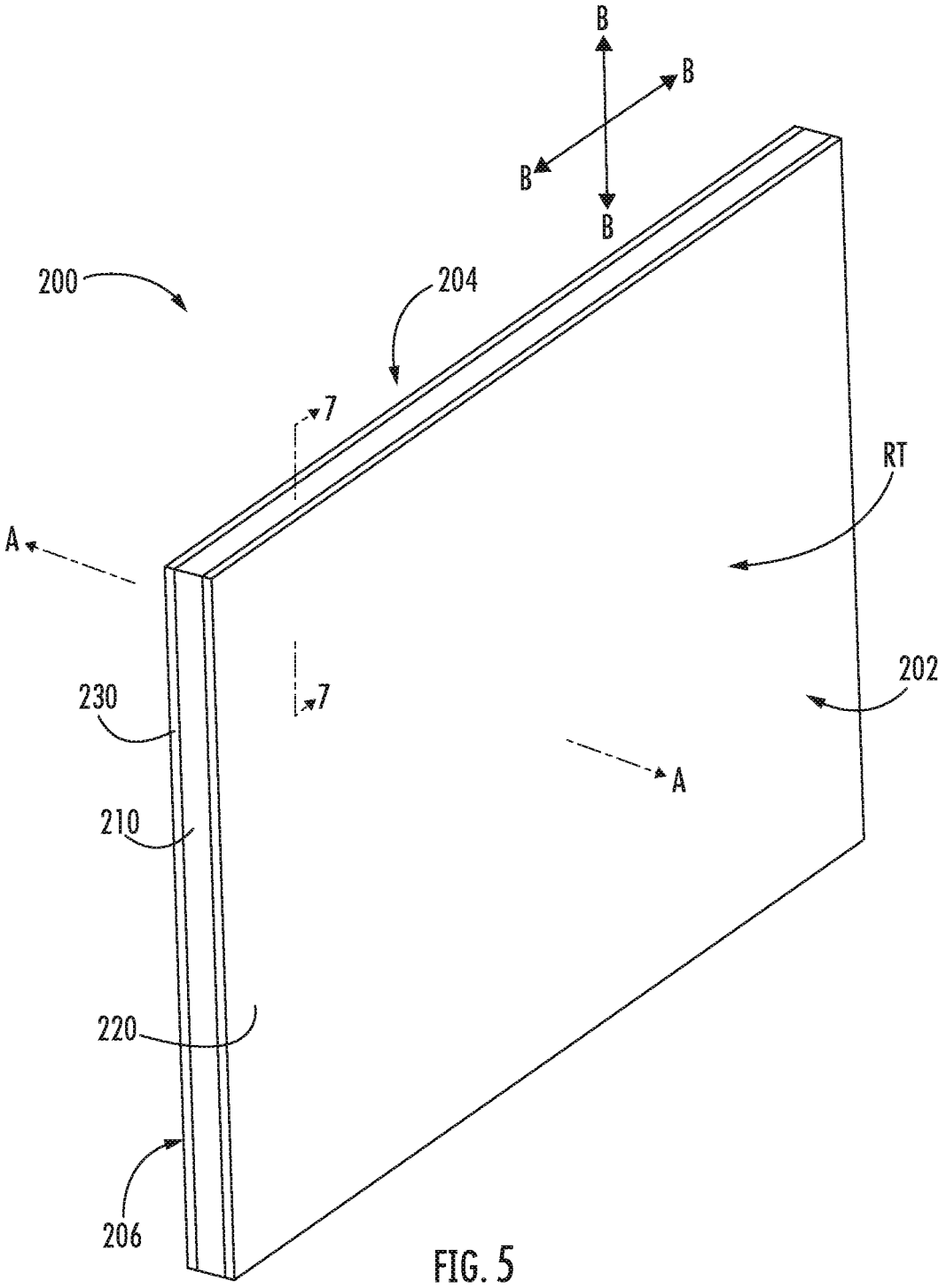
FIG. 5 is a front perspective view of a shroud member according to some embodiments.
Figure 6:
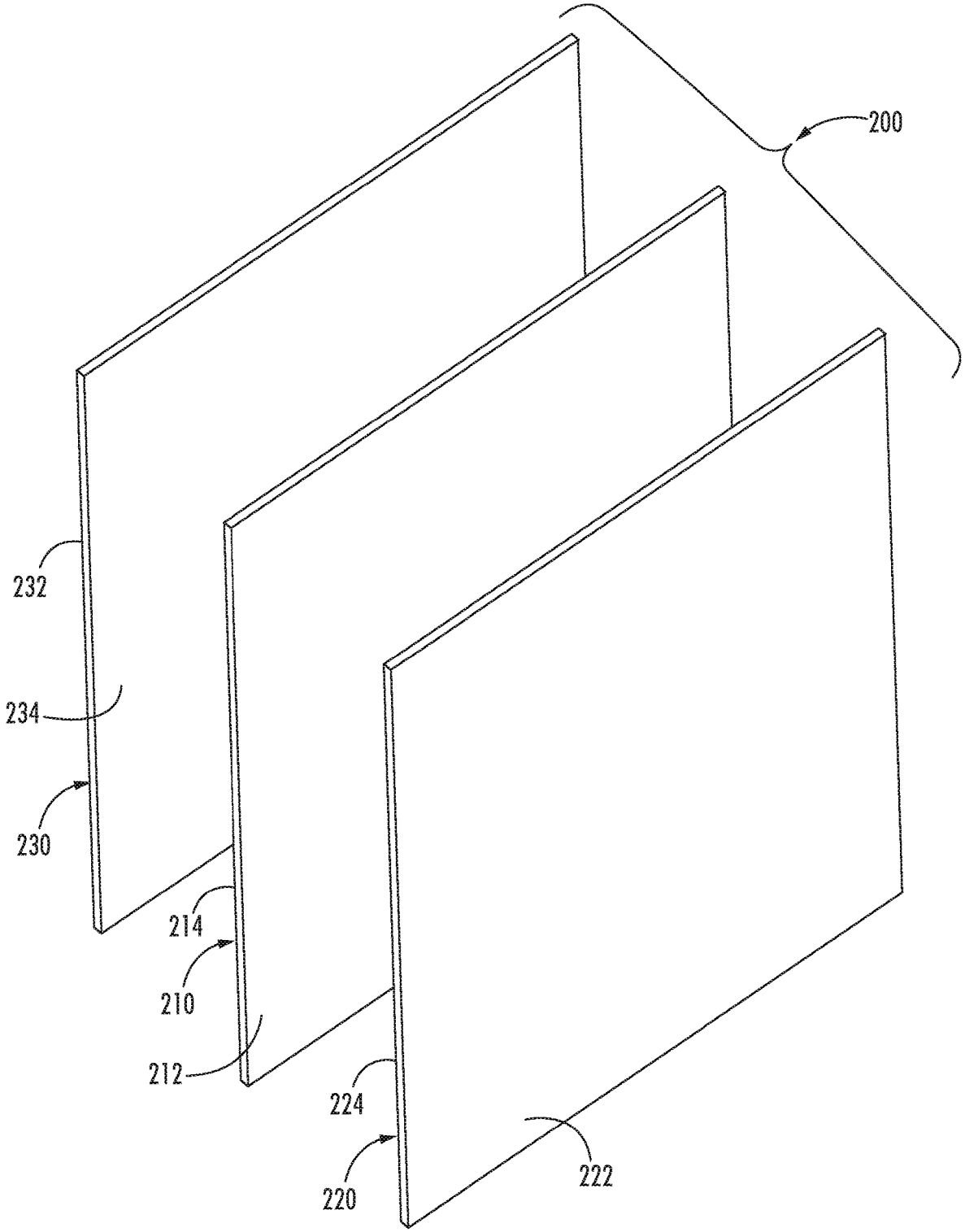
FIG. 6 is an exploded, front perspective view of the shroud member of FIG. 5.
Figure 7:
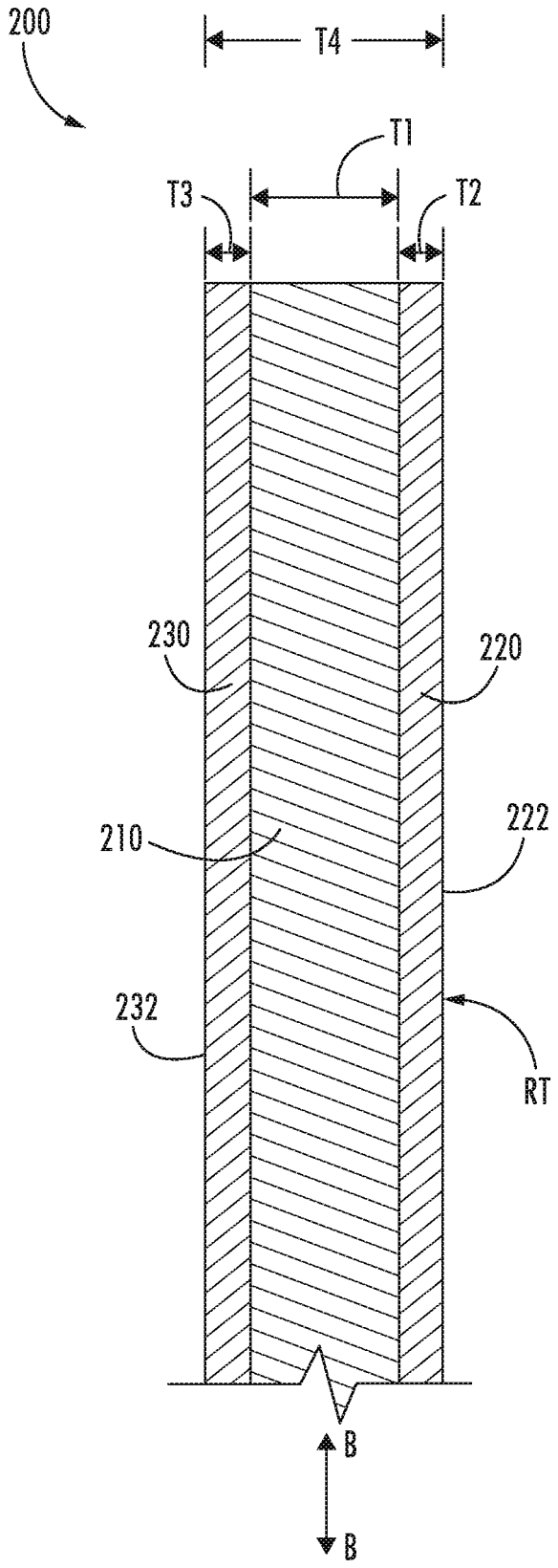
FIG. 7 is a fragmentary, cross-sectional view of the shroud member of FIG. 5 taken along the line 7-7 of FIG. 5.

With reference to FIGS. 5-7, a shroud member 200 according to some embodiments is shown therein. The shroud member 200 may be used as the shroud member 130 of FIG. 3, or a portion of the shroud member 130 through which mmWave 5G RF signals are transmitted to one or more of the antennas 32-2, 32-2, and 32-3 for example.

The shroud member 200 includes a PVC substrate having a multilayer construction as described herein. More particularly, the shroud member 200 includes a core layer 210, a first or front skin layer 220, and a second or rear skin layer 230. The core layer 210 is interposed or sandwiched between the skin layers 220 and 230 as discussed in more detail below.

In some embodiments, the core layer 210 is a foamed PVC layer as described above, and may have the material(s), attributes, properties and constructions discussed above. In some embodiments, the skin layers 220, 230 are nonfoamed PVC sheets or layers as described above, and may have the material(s), attributes, properties and constructions discussed above for the nonfoamed PVC sheets.

The shroud member 200 has a primary axis A-A. The shroud member 200 has a first, or front face 202 and an opposing second or rear face 204 spaced apart along the primary axis A-A. The shroud member 200 includes a peripheral edge 206. In the illustrated embodiment, the shroud member 200 is a flat panel, and the shroud member 200 and each of its layers 210, 220, 230 are substantially planar and define a heightwise and widthwise plane B-B that is orthogonal to the primary axis A-A.

The shroud member 200 includes a target region RT. In the illustrated embodiment, the target region RT may include the entire shroud member 200.

In service, the target region RT is the region of the shroud member 200 through which radio signals are intended to be directed. More particularly, in some embodiments the shroud member 200 is installed such that it is interposed between an antenna (e.g., the antennas 32-2, 32-2, and 32-3 of FIG. 1B) and intended user equipment (e.g., the user equipment UE 110*a-c* of FIG. 1). In this way, radio signals to and from a radiating element of the antenna travel a path through the target region RT of the shroud member 200. In some embodiments, the antenna is a millimeter-wave 5G emitting antenna.

The core layer 210 includes a front surface 212 and an opposing rear surface 214. In some embodiments, the surfaces 212 and 214 are each substantially planar and parallel to one another.

The front skin layer 220 covers the front surface 212 of the core layer 210. The front skin layer 220 includes an outer surface 222 and an opposing inner surface 224. The outer surface 222 faces outward from the core layer 210 and the inner surface 224 is positioned adjacent the front surface 212 of the core layer 210.

In some embodiments, the inner surface 224 is disposed in intimate and direct contact with the front surface 212. In some embodiments, the inner surface 224 is secured to the front surface 212. In some embodiments, the inner surface 224 is bonded to the front surface 212.

In some embodiments, the outer surface 222 is exposed and noncovered. In some implementations, the outer surface 222 of the front skin layer 220 is directly exposed to the environment surrounding the concealment. In some embodiments, the outer surface 222 is covered by a coating (e.g., for coloring and/or weather resistance), as discussed herein.

The rear skin layer 230 covers the rear surface 214. The rear skin layer 230 includes an outer surface 232 and an opposing inner surface 234. The outer surface 232 faces outward from the core layer 210 and the inner surface 234 is positioned adjacent the rear surface 214 of the core layer 210.

In some embodiments, the inner surface 234 is disposed in intimate and direct contact with the rear surface 214. In some embodiments, the inner surface 234 is secured to the rear surface 214. In some embodiments, the inner surface 234 is bonded to the rear surface 214.

In some embodiments, the outer surface 232 is exposed and noncovered. In some embodiments, the installation including the shroud member 200 is configured such that no other components (other than air or other gas) are disposed between the radiating element and the target region RT of the outer surface 232.

In some embodiments, the three layers 210, 220, 230 collectively form a unitary structure. In some embodiments, the skin layers 220, 230 are secured (and, in some embodiments, bonded) to the core layer 210 as discussed above to form the unitary structure.

In some embodiments, the core layer 210 is monolithic. In some embodiments, the skin layers 220, 230 are each monolithic. In some embodiments, the core layer 210 and the skin layers 220, 230 are each monolithic.

The layers 210, 220, 230 have thicknesses T1, T2, and T3, respectively (FIG. 7). In some embodiments, the thickness T1, T2, and T3 of each layer 210, 220, and 230 is substantially uniform throughout the target region RT. In some embodiments, the thicknesses T1, T2, T3 are substantially uniform across the entire height and width of the shroud member 200. In some embodiments, the thickness T1 of the layer 210 varies by no more than 0.1 mm across the target region RT. In some embodiments, the thicknesses T2 and T3 of the layers 220 and 230 each vary by no more than 0.05 mm across the target region RT.

In some embodiments, the thickness of the shroud member 200 is substantially uniform thickness T4 throughout the target region RT. In some embodiments, the thickness T4 of the shroud member 200 is substantially uniform across the entire height and width of the shroud member 200. In some embodiments, the thickness T4 of the shroud member 200 varies by no more than 0.2 mm across the target region.

The shroud member 200 may be formed using any suitable technique. In some embodiments, the skin layers 220, 230 are extruded onto the core layer 210, which may also be extruded. In some embodiments, one or both of the skin layers 220, 230 is/are co-extruded with the core layer 210.

In some embodiments, the skin layers 220, 230 and the core layer 210 each independently have a thickness T1, T2, T3 of about 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, or 10 mm. In some embodiments, a ratio of the thickness T2 of skin layer 220 to the thickness T3 of skin layer 230 is about 1:2, 1:1, or 2:1 (skin layer 220:skin layer 230). In some embodiments, a ratio of the thickness T2 of skin layer 220 to the thickness T1 of core layer 210 is about 2:1, 1:1, 1:2, 1:3, 1:4, 1:5, 1:6, 1:7, 1:8, 1:9, or 1:10 (skin layer 220:core layer 210). In some embodiments, a ratio of the thickness of skin layer 230 T3 to the thickness of core layer 210 T1 is about 2:1, 1:1, 1:2, 1:3, 1:4, 1:5, 1:6, 1:7, 1:8, 1:9, or 1:10 (skin layer 230:core layer 210).

In some embodiments, the core layer thickness T1 is in the range of from about 1.4 mm to 9.4 mm, and each of the skin layer thicknesses T2, T3 is in the range of from about 0.28 mm to about 0.32 mm.

The multi-layer construction and geometry of the shroud member 200 may provide several benefits. The rigid PVC skin layers 220, 230 in combination with the foamed PVC core layer 210 exhibit substantially greater strength and rigidity as compared to a foamed PVC core of the same dimensions alone. The multi-layer construction may substantially improve both the bending resistance (stiffness) and the break resistance of the shroud member 200. The multi-layer construction, particularly constructed with dimensions and material properties as described herein, can provide these advantages without significantly or unduly diminishing the RF electrical performance of the shroud member 200 as compared to a foamed PVC core without the skin layers 220, 230.

The front skin layer 220 may be advantageously formed with a smooth, nontextured finish on its outer surface 222. The smooth finish improves the hydrophobicity of the surface 222 and promotes shedding of water from the surface 222 as compared to a more textured surface. In some embodiments, the outer system 232 of the rear skin layer 230 is also formed with a smooth finish. In some embodiments, the surface roughness, smoothness or finish of each surface 222, 232 is at least as smooth as Finishing Level 4 according to Gypsum Association GA-214-96 and, in some embodiments, at least as smooth as Finishing Level 5.

The skin layers 220, 230 may also provide improved weather resistance. The skin layers 220, 230 can provide a better surface for applying a coating for aesthetics (e.g., coloring) and/or weather proofing.

The multi-layer construction of the shroud member 200 may facilitate manufacture of the shroud member 200. The skin layers 220, 230 may improve the integrity of the shroud member stock material during handling, cutting, forming (e.g., bending), bonding, and/or fastening.

The multi-layer construction of the shroud member 200 may also facilitate installation and extend the service life of the shroud member 200. Again, the skin layers 220, 230 may improve the integrity of the shroud member stock material during handling, cutting, forming (e.g., bending), bonding, and/or fastening during the installation procedure.

In some embodiments, the shroud member 200 is constructed as follows:

- The shroud member 200 is a three-layer sheet (i.e., the PVC substrate) including a core layer 210, and a front skin layer 220 and a rear skin layer 230 bonded or laminated directly to the opposing faces 212 and 214, respectively, to form a unitary structure (e.g., the layers 210, 220, 230 are coextruded);
- The core layer 210 is formed of a foamed PVC;
- The skin layers 220, 230 are each formed of a non-foamed PVC;

The shroud member 200 has an overall thickness T4 in the range of from about 2 mm to 10 mm;

The core layer 210 has a thickness T1 in the range of from about 1.4 mm to 9.4 mm;

The skin layers 220, 230 each have a thickness T2, T3 in the range of from about 0.28 to 0.32 mm;

The core layer 210 has a density in the range of from about 0.5 g/cm$^3$ to about 0.6 g/cm$^3$; and The skin layers 220, 230 each have a density in the range of from about 1 g/cm$^3$ to about 3 g/cm$^3$.

In some embodiments, the shroud member 200 constructed as described immediately above includes only the three structural layers 210, 220, 230, without a fourth structural layer or coating.

In alternative embodiments, the shroud member 200 constructed as described immediately above includes the three structural layers 210, 220, 230 and also a coating on the outer face 222 of the front skin layer 220 and/or a coating on the outer face 232 of the rear skin layer 230, without a fourth structural layer. The coating may provide UV resistance and/or color.

In alternative embodiments, the shroud member 200 is constructed as described immediately above, except that the shroud member 200 includes only the core layer 210 and the front skin layer 220, without the rear skin layer 230 or any additional structural layer. In some embodiments, this construction of the shroud member 200 includes a coating on the outer face 222 of the front skin layer 220.

In some embodiments of each of the embodiments described immediately above, the thicknesses T1, T2, T3 are substantially uniform across the entire height and width of the shroud member 200. In some embodiments, the thickness T1 of the core layer 210 varies by no more than 0.1 mm across the target region RT. In some embodiments, the thicknesses T2 and T3 of the skin layers 220 and 230 each vary by no more than 0.05 mm across the target region RT.

In some embodiments of each of the embodiments described immediately above, the core layer 210 and the skin layers 220, 230 are each monolithic. In some embodiments, the core layer 210 and the skin layers 220, 230 are each homogeneous.

In some embodiments of each of the embodiments described immediately above, the shroud member 200 has a dielectric constant in the range of from about 2 to about 6.

With reference to FIGS. 8-14, a wireless communication equipment installation 303 according to some embodiments is shown therein. The installation 303 includes a concealment system 301 and wireless equipment 80.

The wireless equipment 80 includes one or more antennas 82. In some embodiments and as illustrated, the antenna 82 forms a part of an integrated radio/antenna unit 81 that includes both the antenna 82 and a radio 84. In other embodiments, the radio 84 may connected to the antenna 82 but located remotely from the antenna 82. The antenna 82 includes a radiating element 83. It will be appreciated that the radio/antenna unit 81 may include multiple antennas 82, and each antenna 82 may include multiple RF radiating elements 83.

The antenna 82 is configured to emit radio (RF energy) signals from the radiating element 83 in a forward direction DE. The radio signals are generated by the radio 84. In some embodiments, the radio 84 and the antenna 82 are configured to (and, in operation do) emit millimeter-wave 5G radio communication signals via the radiating element 83.

The concealment system 301 includes a base concealment member 340, a support structure 344, a shroud assembly 351, and an antenna mounting system 360.

In the illustrated embodiment, the base concealment member 340 is a flat panel and will be referred to hereinafter as the base panel 340. The base panel 340 may serve as an aesthetic visual barrier. The base panel 340 may be mounted on a building or other structure to conceal the wireless equipment 80 as well as other wireless equipment. The base panel 340 may be supported on the building or other structure by the support structure 344. Additional concealment members 340' may be positioned and secured adjacent the base concealment member 340.

The base panel 340 has a front face 342A and an opposing rear face 342B. A window or aperture 346 is defined in the base panel 340 by a surrounding aperture sidewall 346A. A front aperture edge 347 is defined at the intersection the aperture wall 346A and the front face 342A.

The shroud assembly 351 includes a shroud member 300 and a shroud mounting system 350.

The shroud member 300 is constructed as described above for the shroud member 200. Accordingly, the disclosure herein regarding the shroud member 200 and shroud members according to embodiments of the invention generally likewise applies to the shroud member 300. The shroud member 300 includes a front face 302 (corresponding to the front face 202), a rear face 304 (corresponding to the rear face 204), and a peripheral edge 306 (corresponding to the peripheral edge 206).

The shroud mounting system 350 includes a frame 352. The frame 352 includes a subframe 354 and a flange plate 356. The subframe 354 may be formed of one or more tubular members that are joined or bent into the shape illustrated. The subframe 354 defines an opening 354A. The subframe 354 has a front face 354B and an opposing rear face 354C. The flange plate 356 defines an opening 356A. The flange plate 356 is affixed to the rear face 354C such that the openings 354A, 356A are aligned. The flange plate 356 may be affixed to the rear face 354C by adhesive, solder, welding, fasteners or any other suitable method. In other embodiments, the frame 352 may be formed as a stamped member including features of both the subframe 354 and the flange plate 356.

The shroud member 300 is affixed to the front face 354B of the subframe 354. The shroud member 300 may be affixed to the front face 354B using any suitable technique. For example, in some embodiments, the shroud member 300 is secured to the front face 354B by adhesive 358 that bonds peripheral portions 304A of the rear face 304 to the front face 354B.

The shroud member 300 is aligned with the openings 354A, 356A such that the target region RT of the shroud member 300 spans the openings 354A, 356A. In some embodiments and as shown, the shroud member 300 fully covers the openings 354A, 356A.

In the installation, the frame 352 is seated in the aperture 346 such that the flange plate 356 overlaps portions of the rear face 342B surrounding the aperture 346, and the subframe 354 is seated in the aperture 346. The frame 352 is secured in the aperture 346. For example, the flange plate 356 may be bonded to the rear face 342B by adhesive 359.

In some embodiments and as illustrated, when the shroud assembly 351 is installed in the base panel 340 as described, the front face 302 of the shroud member 300 is positioned substantially coplanar with the front face 342A of the base panel 340.

The antenna mounting system 360 includes coupling brackets 362, a rail 364, and an antenna bracket 366. The coupling brackets 362 are secured (e.g., by fasteners or welding) to the frame 352. The rail 364 is mounted on the coupling brackets 362. The antenna bracket 366 is in turn adjustably mounted on the rail 364. The radio/antenna unit 81 is mounted on the antenna bracket 366. The antenna 82 is mounted and positioned such that the radiating element 83 emits radio signals in the forward direction DE through the target region RT.

In some embodiments, the radiating element 83 of the antenna 82 is spaced apart from the shroud member 300. In some embodiments, the radiating element 83 is spaced apart from the shroud member 300 a distance D3 (FIG. 9) in the range of from about 5 mm to 60 mm.

The antenna mounting system 360 may be configured to permit a user to adjust the position of the antenna 82 relative to the aperture 346. The antenna mounting system may be configured to permit the user to adjust the distance between the antenna 82 and the shroud member 300.

In some embodiments, the base concealment member 340 is formed of a material that is thicker than, denser than, has a higher dielectric constant than, and/or has a greater flexural strength than the material of the shroud member 300. In some embodiments, the concealment member 340 is formed of a material that is stronger than the material of the shroud member 300.

In some embodiments, the base concealment member 340 is formed of fiberglass reinforced polymer (FRP). In some embodiments, the base concealment member 340 is formed of FRP, plastic, a plastic and foam composite sandwich, or other composite material.

In some embodiments, the shroud member 300 is mounted in the base panel 340 in the field (i.e., instead of in a factory). In some embodiments, the shroud member 300 is retrofitted into an existing base panel 340 that is already in service. In this case, the installer will cut the aperture 346 into the base panel 340. The installer will then install the shroud assembly 351 in the aperture 346 as described above.

The subframe 354 and the flange plate 356 may be formed of any suitable materials. In some embodiments, the subframe 354 and the flange plate 356 are formed of FRP.

In some embodiments, the width and height dimensions of the shroud member 300 are substantially the same as or slightly less than the width and height of the aperture so that the shroud member 300 substantially completely fills the aperture 346.

Figure 12:
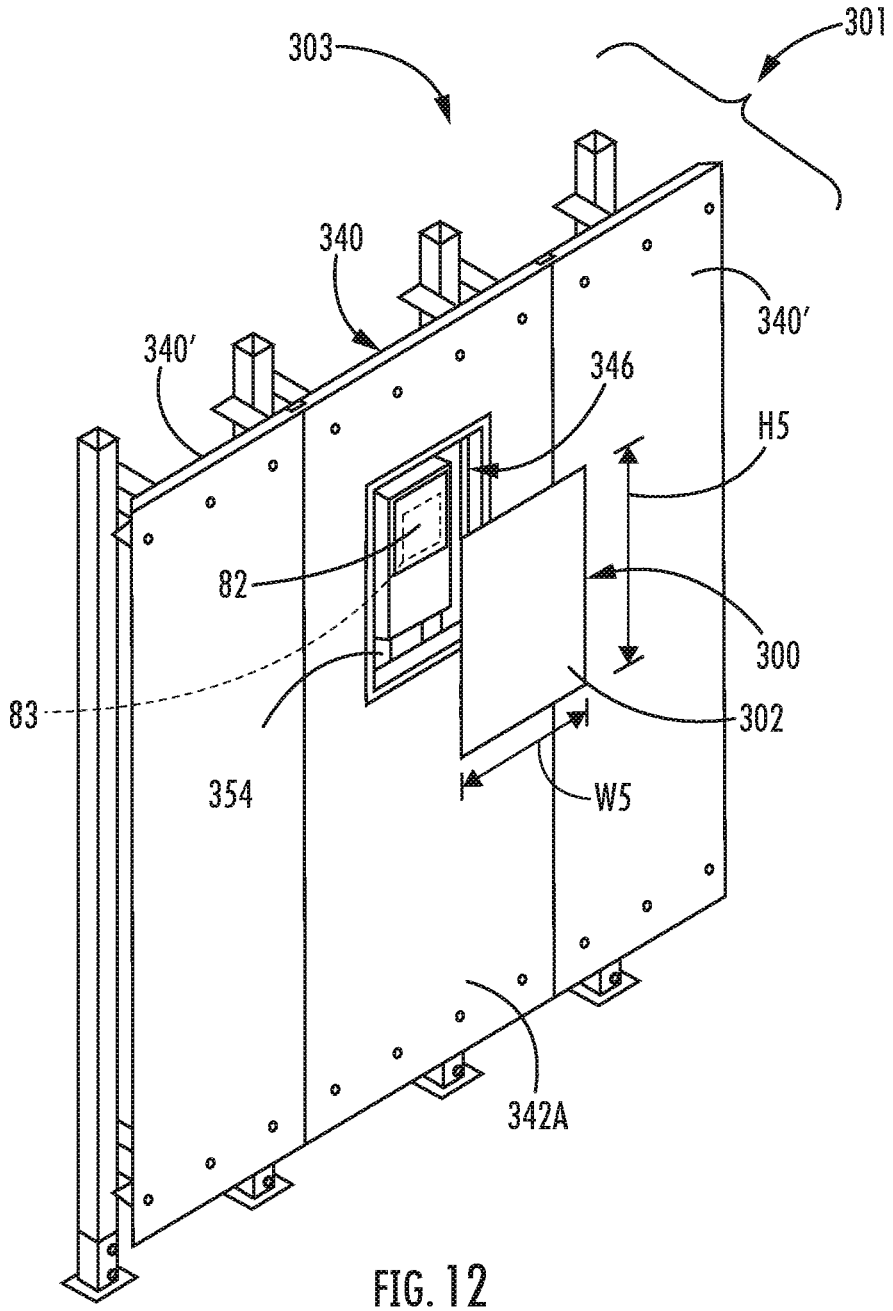
FIG. 12 is an exploded, front perspective view of the wireless communication equipment installation of FIG. 8.
Figure 13:
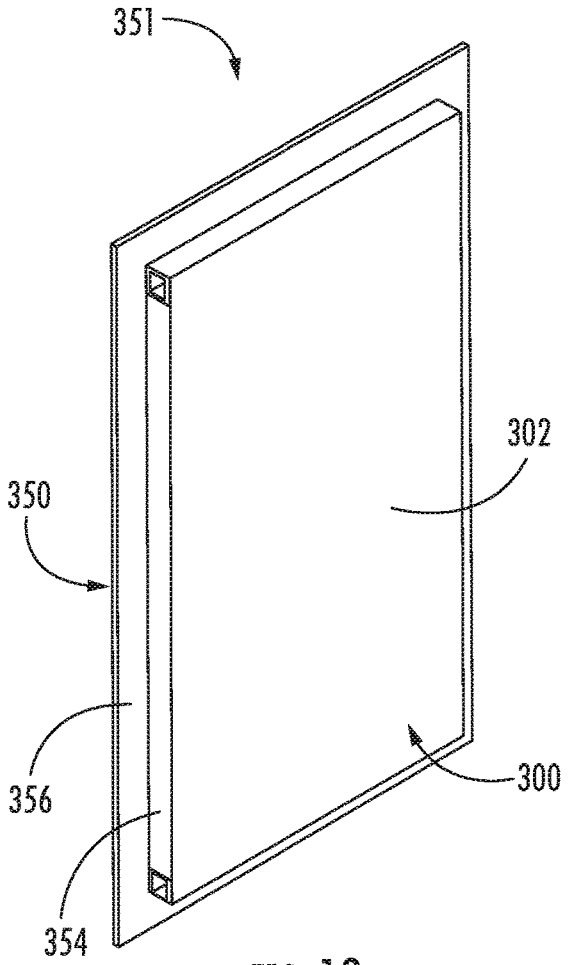
FIG. 13 is a front perspective view of a shroud assembly forming a part of the wireless communication equipment installation of FIG. 8.
Figure 14:
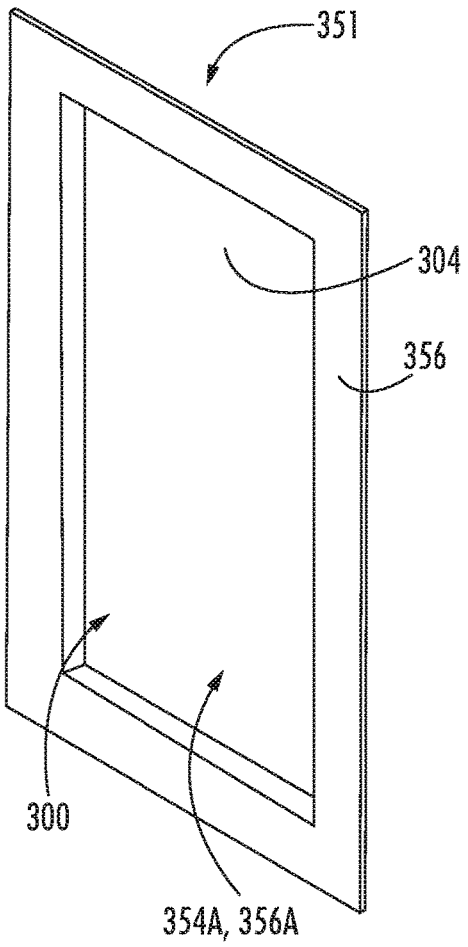
FIG. 14 is a rear perspective view of the shroud assembly of FIG. 13.

In some embodiments, neither the width nor height of the shroud member 300 exceeds 50 inches. In some embodiments, the width W5 and height 115 of the shroud member 300 is in the range of from about 10 to 30 inches (FIG. 12). In some embodiments, the height 115 of the shroud member 300 is in the range of from about 10 to 50 inches. In some embodiments, the area of the front surface 302 is in the range of from about 240 square inches to 1200 square inches.

In some embodiments and as illustrated, the material of the base panel 340 fully surrounds the perimeter of the shroud member 300.

The concealment system 301 and associated methods can enable an installer to obtain the benefits of a shroud member constructed as described herein while maintaining the aesthetic and structural strength advantages of a conventional base concealment member. The shroud member 300 may be structurally weak as compared to the base panel 340. Additionally, the relatively weak shroud member 300 may require good support and may not be suitable to span large distances or areas without support. In the concealment system 301, the area of the shroud member 300 can be limited to the area through which radio signals are intended to be transmitted. The shroud member 300 is supported by the frame 352 and the base panel 340. Other than the aperture 346, the base panel 340 can be constructed and used in a known manner. The shroud assembly 351 can be incorporated into the base panel 340 with little detrimental effect on the appearance or structural integrity of the base panel 340.

With reference to FIGS. 15-20, a wireless communication equipment installation 403 according to some embodiments is shown therein. The installation 403 includes a concealment system 401 and wireless equipment 80.

The wireless equipment 80 includes a plurality (three) of circumferentially distributed integrated radio/antenna units 81. Each radio/antenna unit 81 includes an antenna 82. Each antenna 82 includes a radiating element 83. It will be appreciated that each radio/antenna unit 81 may include multiple antennas 82, and each antenna 82 may include multiple RF radiating elements 83. While FIGS. 15-18 show integrated radio/antenna units 81, in other embodiments the radios 84 may connected to the antennas 82 but located remotely from the antennas 82.

Each antenna 82 is configured to emit radio (RF energy) signals from its radiating element 83 in a respective forward direction DE. The radio signals are generated by the associated radios 84. In some embodiments, the radios 84 and the antennas 82 are configured to (and, in operation do) emit millimeter-wave 5G radio communication signals via the radiating elements 83.

Figure 17:
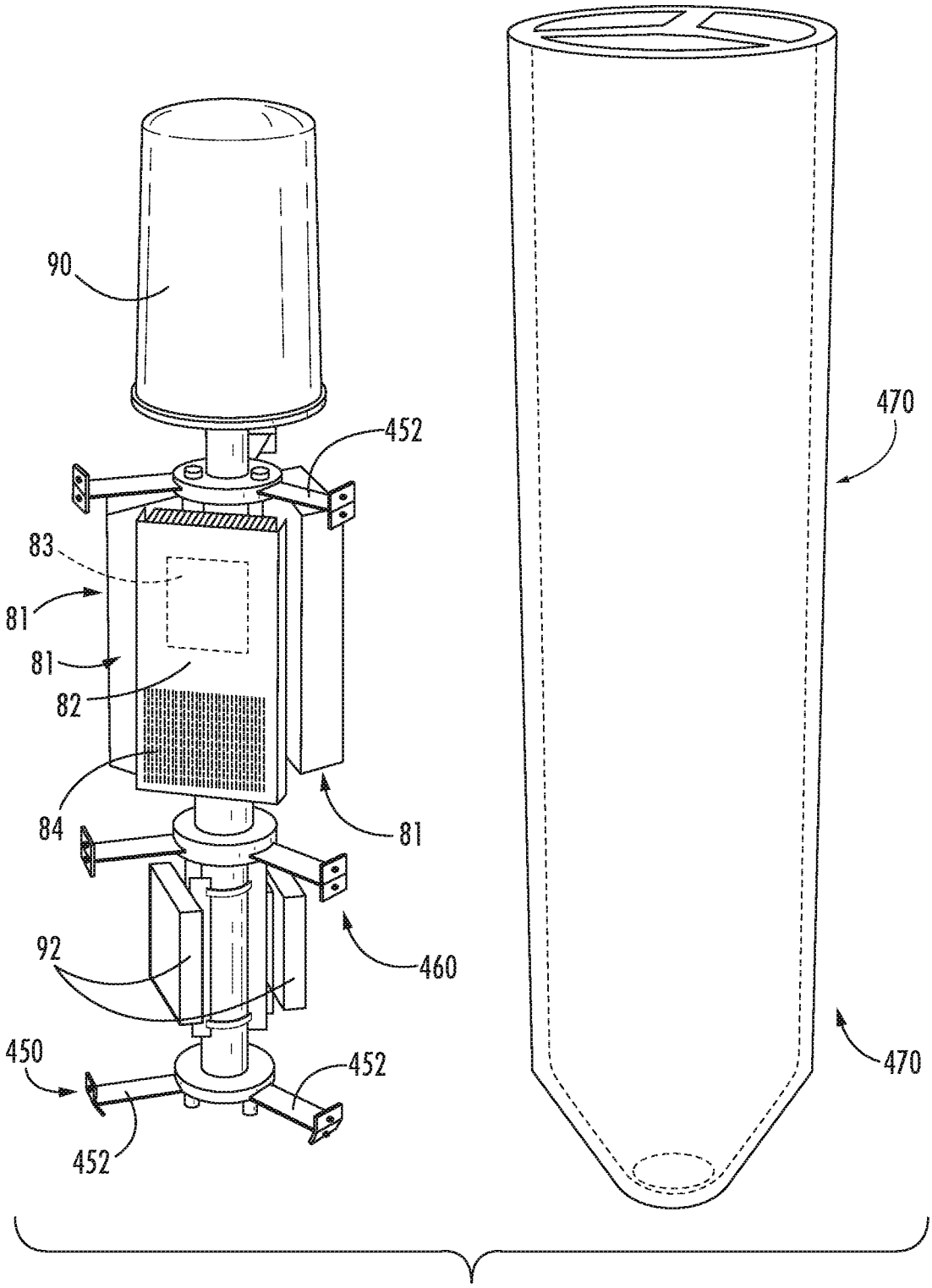
FIG. 17 is an exploded, enlarged, fragmentary, perspective view of the wireless communication equipment installation of FIG. 15.

The installation 403 may be mounted on a suitable support such as a pole 440. For example, the pole 440 may be a monopole that also supports other wireless communication equipment. For example, the pole 440 may also support a 4G band antenna 90 and associated 4G band radios 92 (FIG. 17). The pole 440 may also serve an additional function, such as a light pole.

The concealment system 401 includes a shroud assembly 451 and an antenna mounting system 460.

The shroud assembly 451 includes a shroud support system 450 and a shroud subassembly 470.

The shroud subassembly 470 includes a shroud member 400, reinforcement bands 472, a seam trim strip 474, and adhesive 476.

The shroud member 400 is constructed as described above for the shroud member 200, except that the shroud member 400 is tubular and cylindrically shaped. Accordingly, the disclosure herein regarding the shroud member 200 and shroud members according to embodiments of the invention generally likewise applies to the shroud member 400.

The shroud member 400 has a curved front face 402 (FIG. 19; corresponding to the front face 202) and a curved rear face 404 (corresponding to the rear face 204). The shroud member 400 is bent such that opposed side edges 406A (FIG. 19) thereof meet or are disposed closely adjacent to form a seam 407. The seam trim strip 474 is a fixed to the rear face 404 on either side of the seam 407 to secure the side edges 406A together. The reinforcement bands 472 are secured to the rear face 404 adjacent the top and bottom edges of the shroud member 400 by adhesive, for example.

The shroud support system 450 includes one or more shroud support frames or brackets 452 secured to the pole 440, for example. The shroud subassembly 470 is mounted on the shroud support brackets 452. The shroud support system 450 may further includes an end cap 454 (FIG. 15) or other component mounted in the top of the shroud subassembly 470.

The antenna mount system 460 may include one or more brackets 462 (FIG. 18) that secure the radio/antenna units 81 (and thereby the antennas 82) to the pole 440 such that the antennas 82 face radially outwardly from the pole 440.

Figure 15:
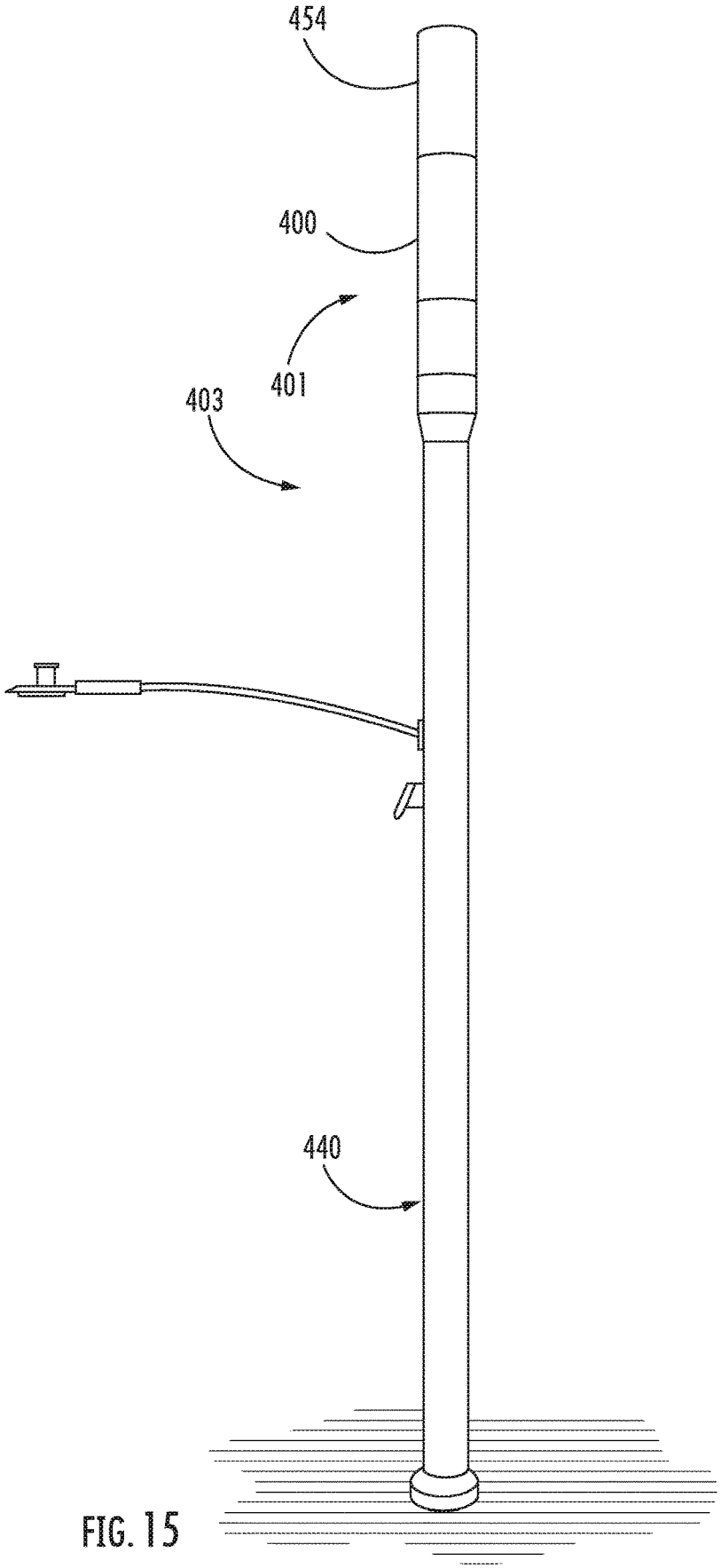
FIG. 15 is a perspective view of a wireless communication equipment installation according to further embodiments.
Figure 16:
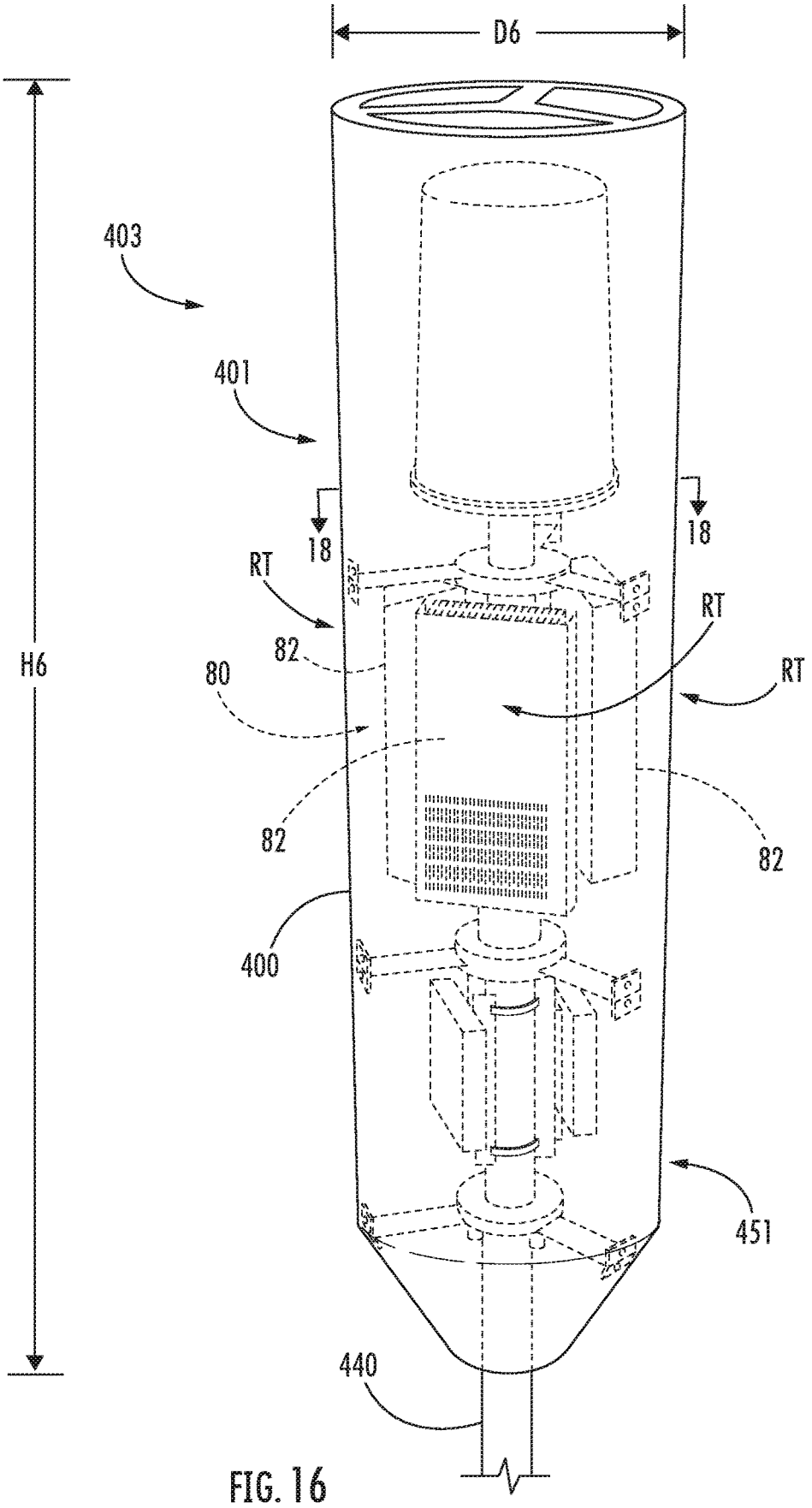
FIG. 16 is an enlarged, fragmentary, perspective view of the wireless communication equipment installation of FIG. 15.
Figure 18:
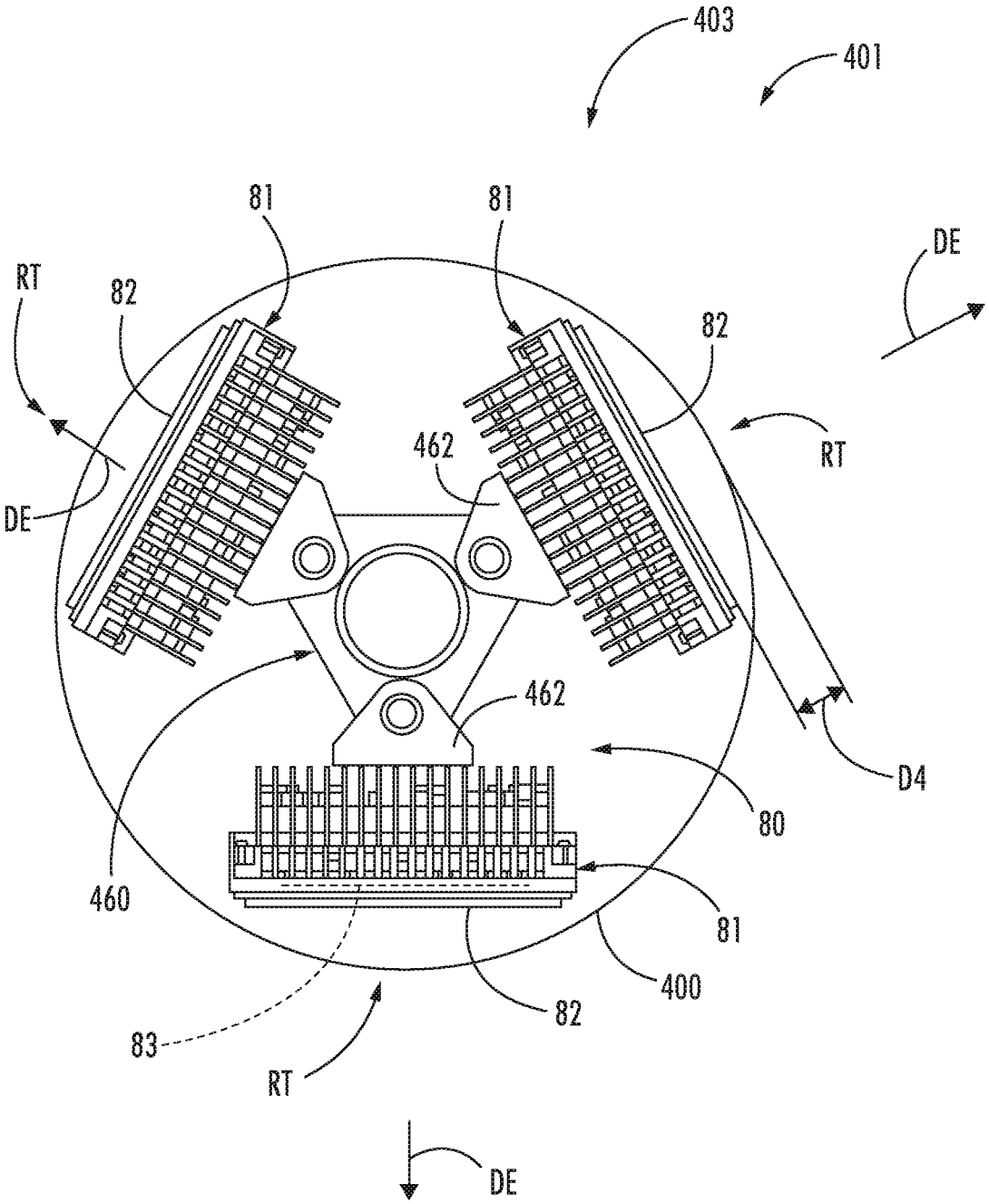
FIG. 18 is a cross-sectional view of the shroud member of the wireless communication equipment installation of FIG. 15 taken along the line 18-18 of FIG. 16.
Figure 19:
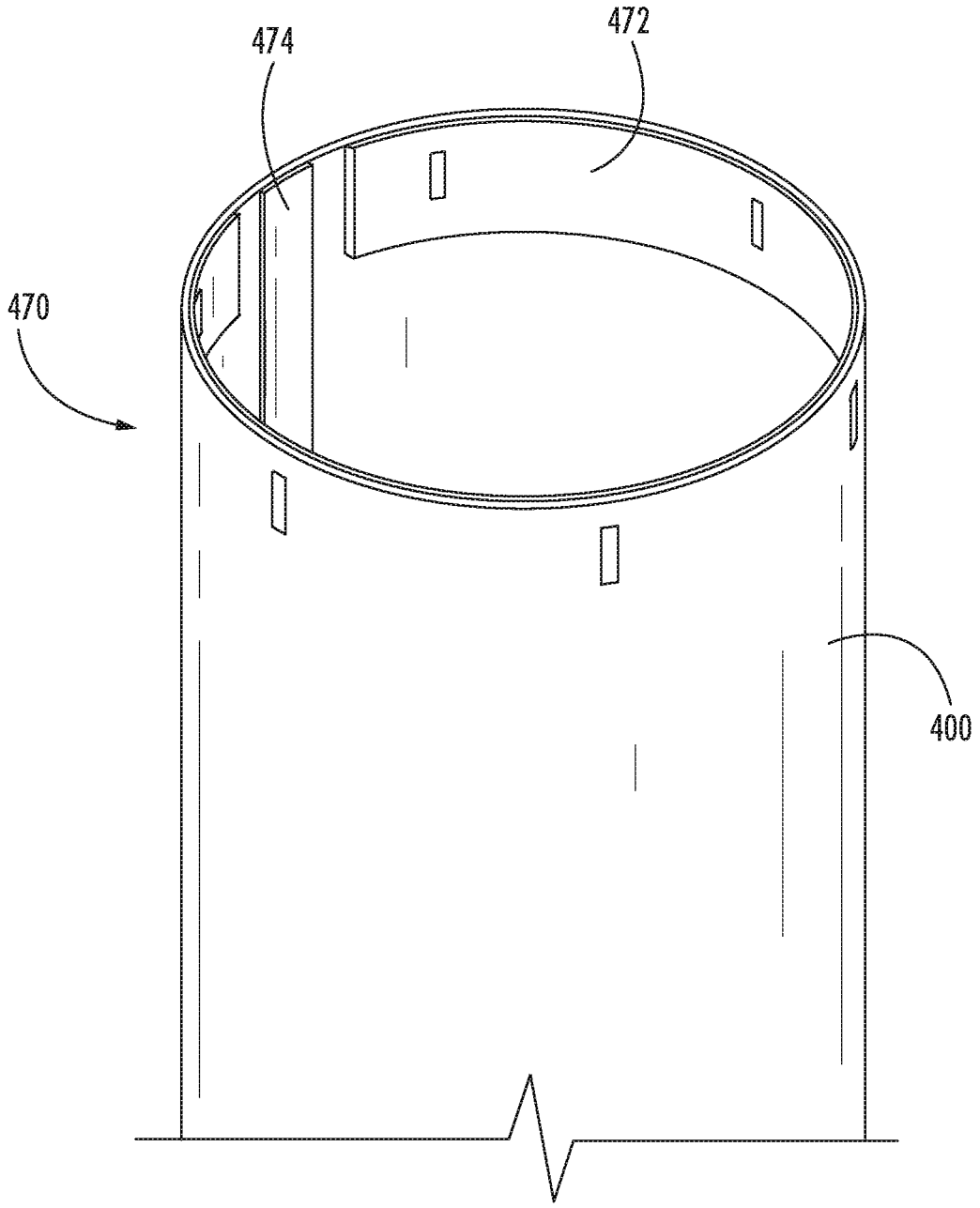
FIG. 19 is a fragmentary, top perspective view of a shroud subassembly forming a part of the wireless communication equipment installation of FIG. 15.
Figure 20:
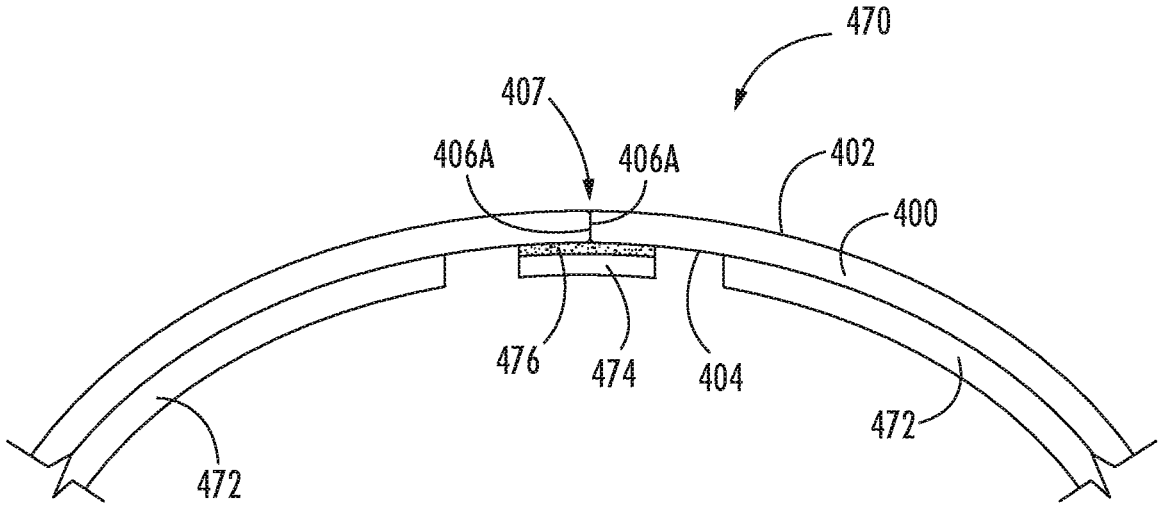
FIG. 20 is a fragmentary, top view of the shroud subassembly of FIG. 19.
Figure 21:
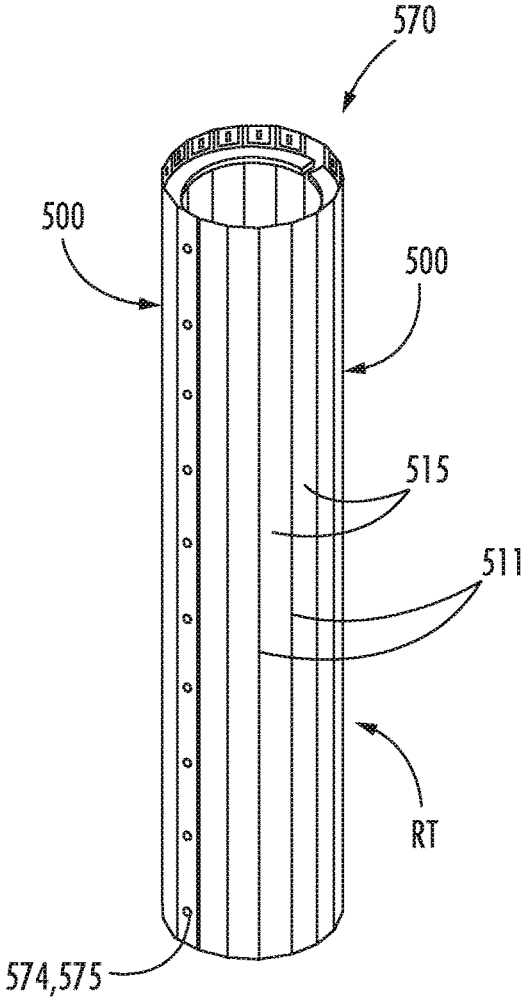
FIG. 21 is a perspective view of a shroud subassembly according to further embodiments.

When the antennas 82 and the shroud subassembly 470 are installed as shown in FIGS. 15, 16 and 18, the radiating elements 83 of the respective antennas 82 are oriented such that they will emit or radiate RF wave signals (e.g., millimeter-wave 5G signals) in respective radially outward direction DE. These RF signals are directed radially outwardly through the target region RT of the shroud member 400. In this embodiment, the target region RT of the shroud member 400 may extend approximately 360 degrees about the pole 440.

In some embodiments, the radiating element 83 of each antenna 82 is spaced apart from the shroud member 400. In some embodiments, the radiating element 83 of each antenna 82 is spaced apart from the shroud member 400 a distance D4 (FIG. 18) in the range of from about 5 mm to 60 mm.

The shroud assembly 451, including the shroud member 400, may be formed using any suitable technique. In some embodiments, the shroud member 400 is formed into the cylindrical shape using the following method. The shroud member 400 is first formed as a substantially flat panel as shown and described for the shroud member 100. The flat panel is then cold formed into the cylindrical, tubular shape. By cold formed, it is meant that the flat panel is mechanically bent into the final shape without application of heat sufficient to melt or make the material of the flat-panel molten. In this manner, the flat panel is formed into the shape of the shroud member 400 without unduly altering the thickness of the shroud member material. In particular, the uniformity of the thickness of the material across the target region RT is maintained.

In some embodiments, the height 116 (FIG. 16) of the shroud member 400 is in the range of from about 24 to 144 inches. In some embodiments, the outer diameter D6 of the shroud member 400 is in the range of from about 12 to 42 inches.

With reference to FIGS. 21-24, a shroud subassembly 570 according to further embodiments is shown therein. The shroud subassembly 570 may be used in place of the shroud subassembly 470, for example. The shroud subassembly 570 differs from the shroud subassembly 470 in that the shroud subassembly 570 has a faceted configuration.

The shroud subassembly 570 includes two shroud members 500, reinforcement bands 572, coupling tabs 574 and coupling slots 575.

The shroud members 500 are constructed as described above for the shroud member 200, except as discussed below. Accordingly, the disclosure herein regarding the shroud member 100 and shroud members according to embodiments of the invention generally likewise applies to the shroud members 500.

Each shroud member 500 includes a core layer 510, a front skin layer 520, and a rear skin layer 530 corresponding to the layers 210, 220, and 230, respectively. Each shroud member 500 has a front face 502, a rear face 504, and opposed side edges 506A and 506B. Circumferentially distributed, longitudinally or axially extending grooves 509 are defined in the rear face 504 of each shroud member 500. An axially extending bend or corner 511 is defined at each groove 509. Circumferentially distributed, axially extending facets 515 (substantially planar outward facing surfaces) are defined between each corner 511. In some embodiments, each facet 515 is substantially planar.

A series of the coupling tabs 574 are provided along the side edge 506A of each shroud member 500. A series of the coupling slots 575 are provided along the side edge 506B of each shroud member 500. The shroud members 500 are mounted in overlapping edge to edge alignment with the tabs 574 of each shroud member 500 interlocked with the slots 575 of the other shroud member 500. The shroud members 500 are thereby combined to form a tubular, faceted structure.

Figure 23:
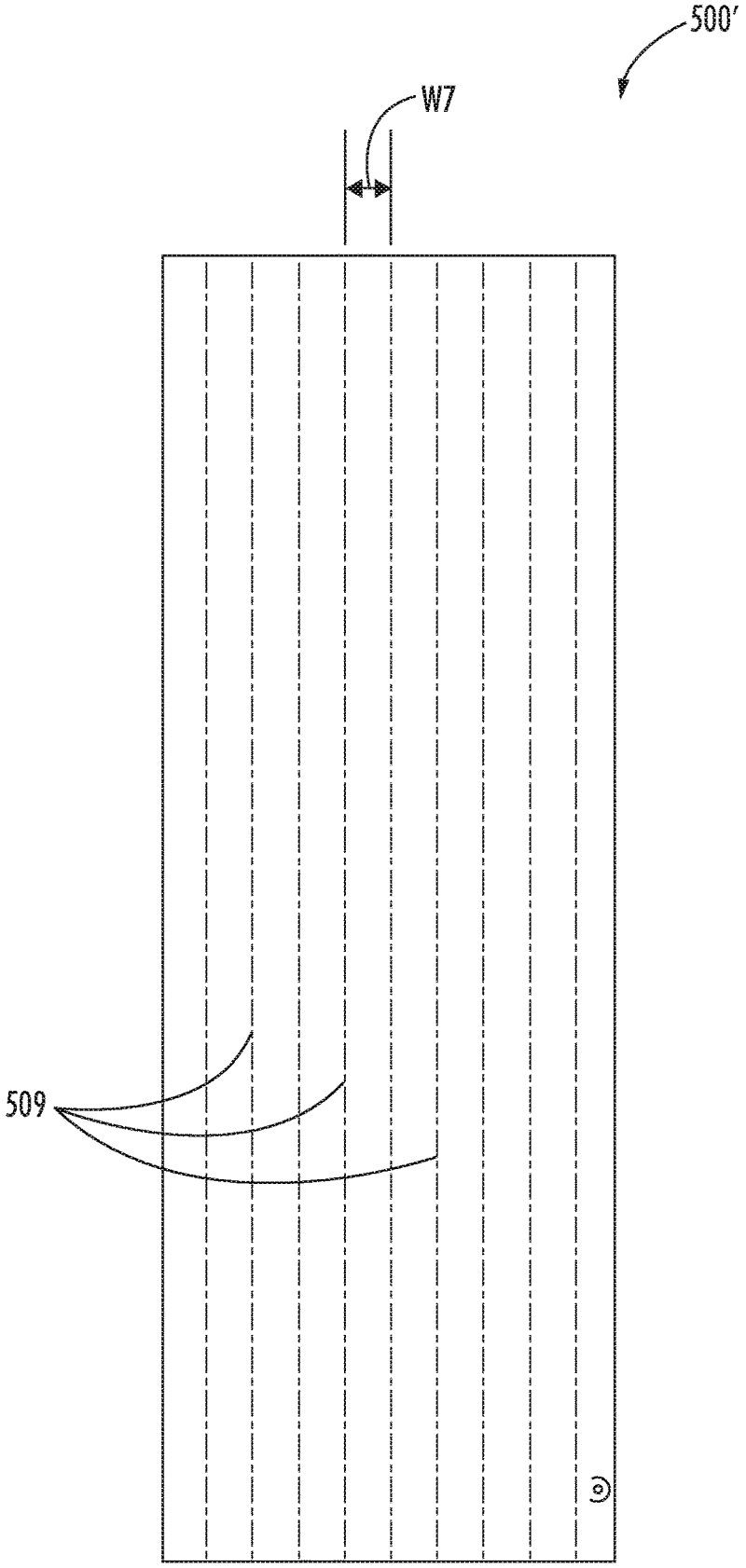
FIG. 23 is a rear view of a flat panel used to form the shroud member of FIG. 22.
Figure 24:
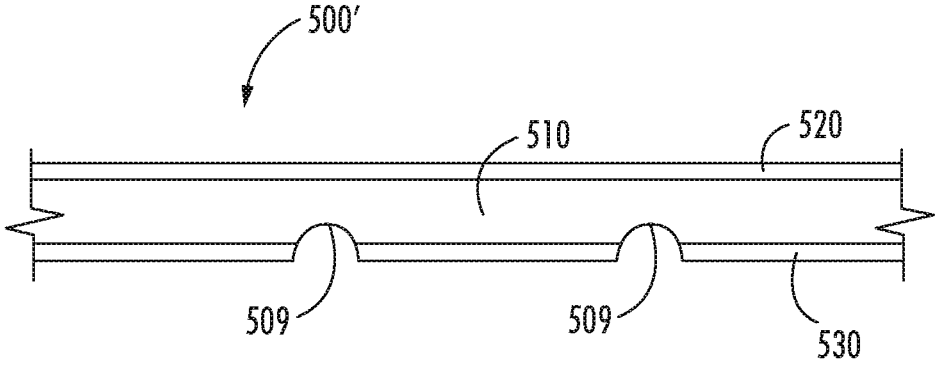
FIG. 24 is a fragmentary, top view of the flat panel of FIG. 23.

Each shroud member 500 may be formed using any suitable technique. In some embodiments, each shroud member 500 is formed into the faceted shape using the following method. The shroud member is first formed as a substantially flat panel 500' as shown and described for the shroud member 200. The grooves 509 are then mechanically formed in the flat panel 500' as shown in FIGS. 23 and 24. In some embodiments, the grooves 509 are formed in the rear surface of the flat panel 500'. In some embodiments, the grooves 509 are formed through the rear skin layer 530.

Figure 22:
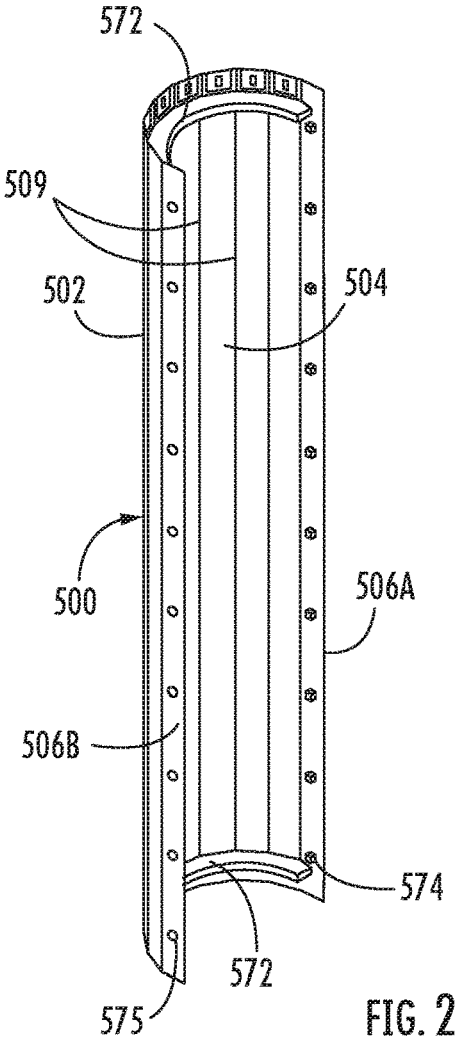
FIG. 22 is a perspective view of a shroud member forming a part of the shroud subassembly of FIG. 21.

The flat panel 500' is then cold formed into the faceted, semi-tubular shape of FIG. 22. By "cold formed", it is meant that the flat-panel is mechanically bent into the final shape without application of heat sufficient to melt or make the material of the flat panel molten. In this manner, the flat panel 500' is formed into the shape of the shroud member 500 without unduly altering the thickness of the shroud member material. In particular, the uniformity of the thickness of the material across the target region RT (other than in the grooves 509) is maintained. In some embodiments, the seams are heat bended.

In some embodiments, the total number of facets 515 in the shroud member 500 is in the range of from about 16 to 20. In some embodiments, each facet 515 has a width W7 (FIG. 23) in the range of from about 2 to 7 inches. In some embodiments, the bend angle between adjacent facets 515 is in the range of from about 20 to 60 degrees.

In accordance with some embodiments, each of the shroud members and concealment systems as disclosed herein is used with an antenna having a radiating element that emits radio signals having a frequency in a range of 24 GHz-100 GHz through the shroud member or the shroud member forming a part of the concealment system.

Figure 25:
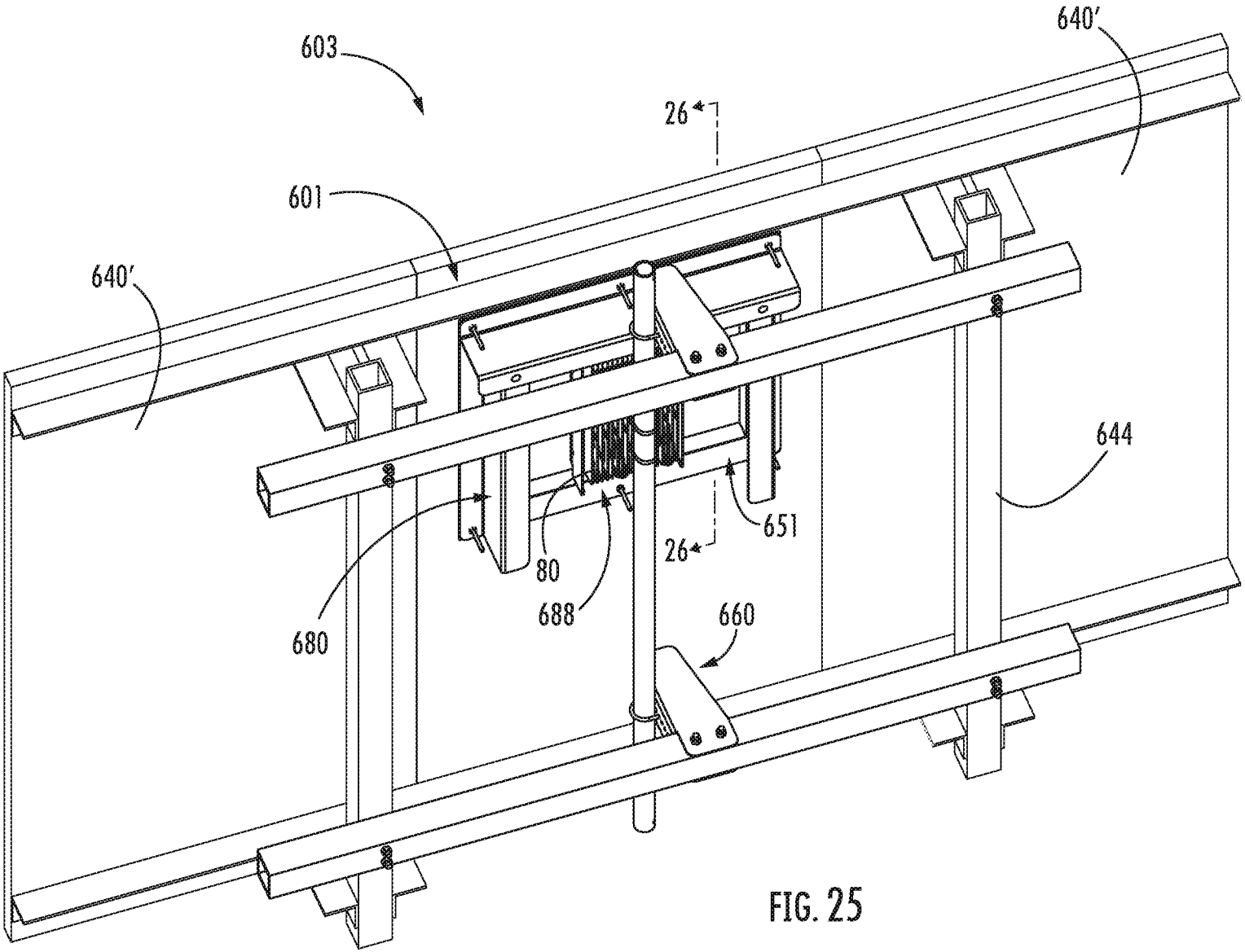
FIG. 25 is a rear perspective view of a wireless communication equipment installation according to some embodiments.
Figure 26:
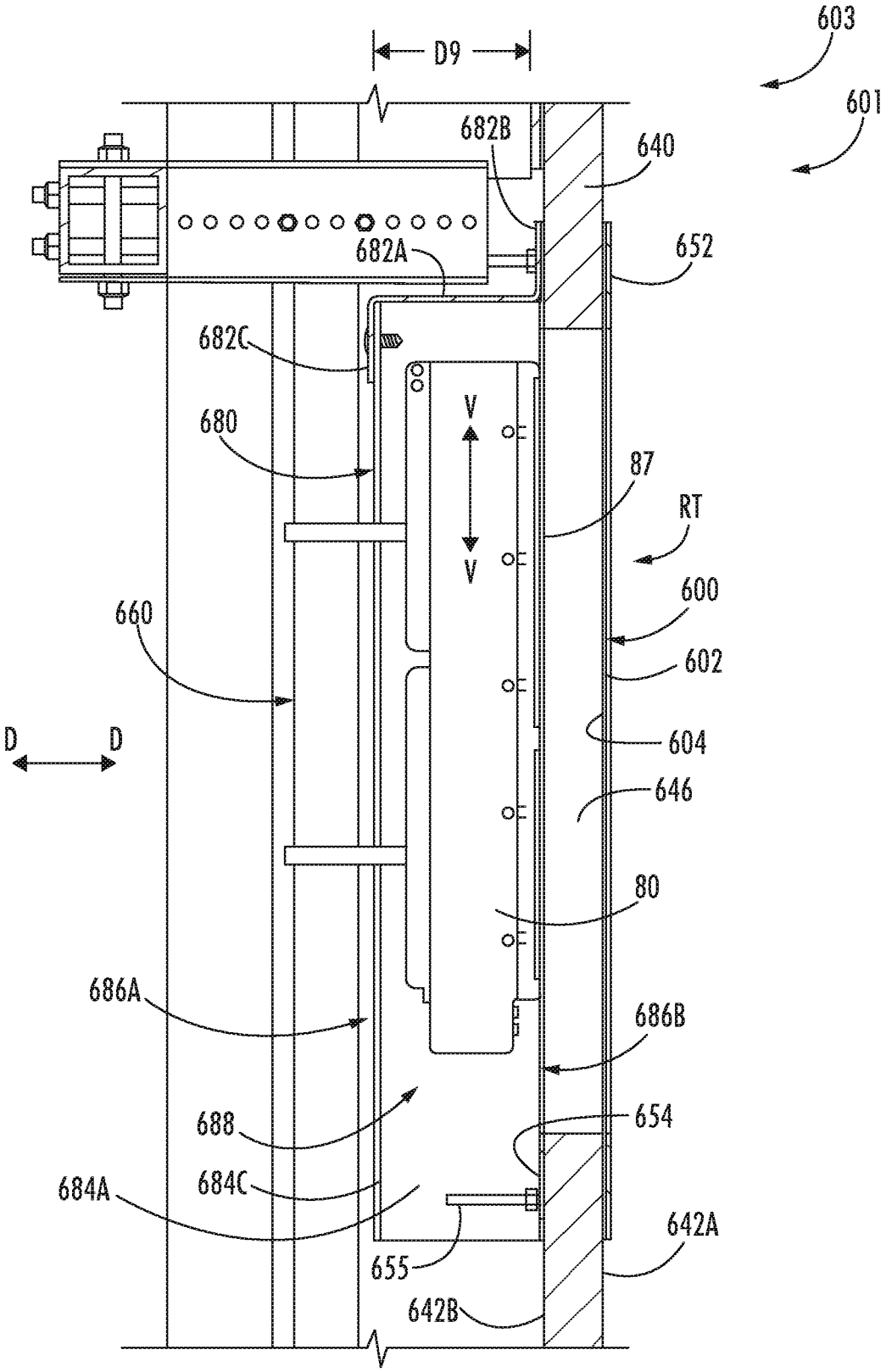
FIG. 26 is an enlarged, cross-sectional view of the wireless communication equipment installation of FIG. 25 taken along the line 26-26 of FIG. 25.
Figure 27:
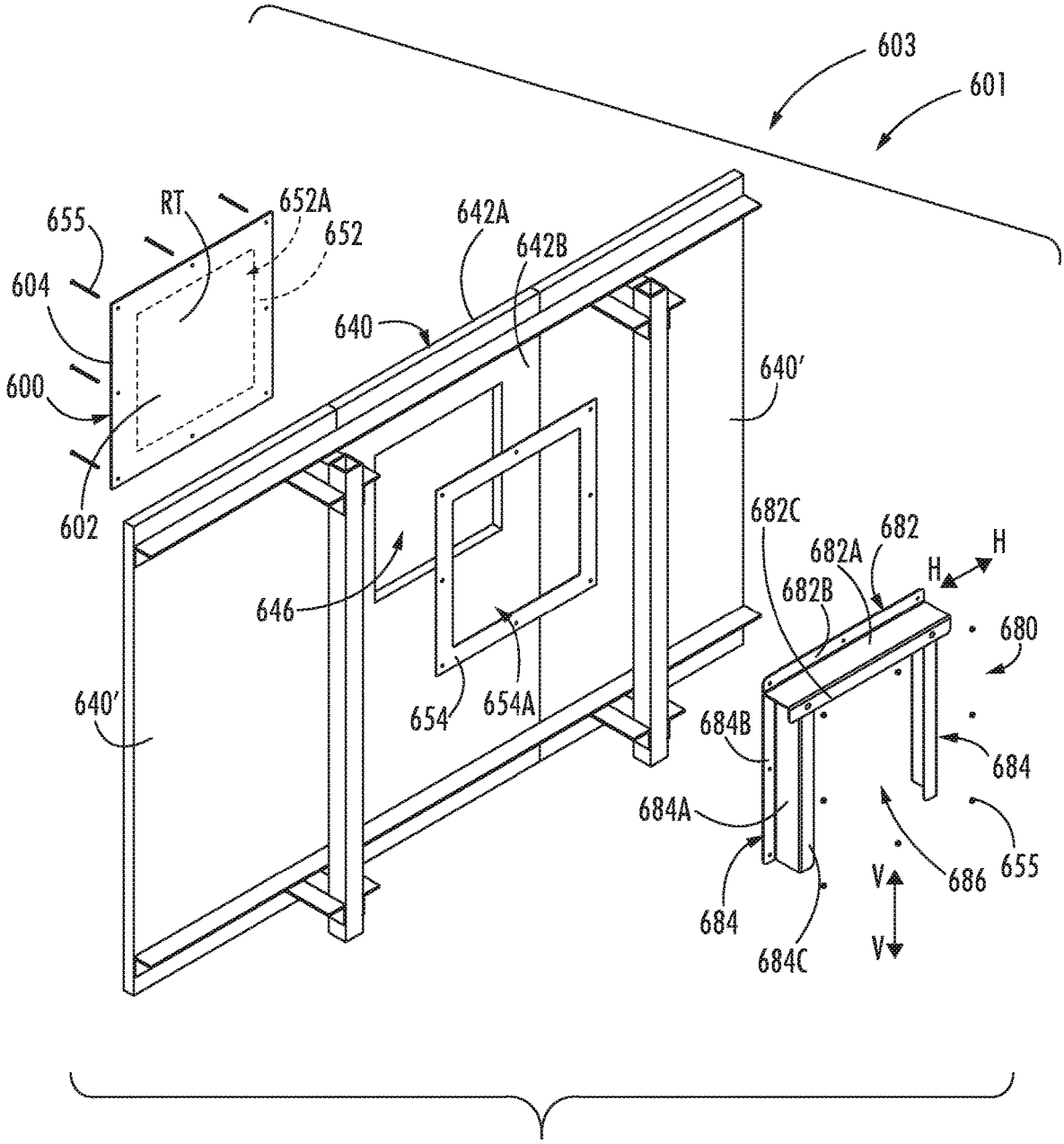
FIG. 27 is an exploded, fragmentary, rear perspective view of the wireless communication equipment installation of FIG. 25.

With reference to FIGS. 25-27, a wireless communication equipment installation 603 according to some embodiments is shown therein. The installation 603 includes a concealment system 601 and wireless equipment 80.

Figure 8:
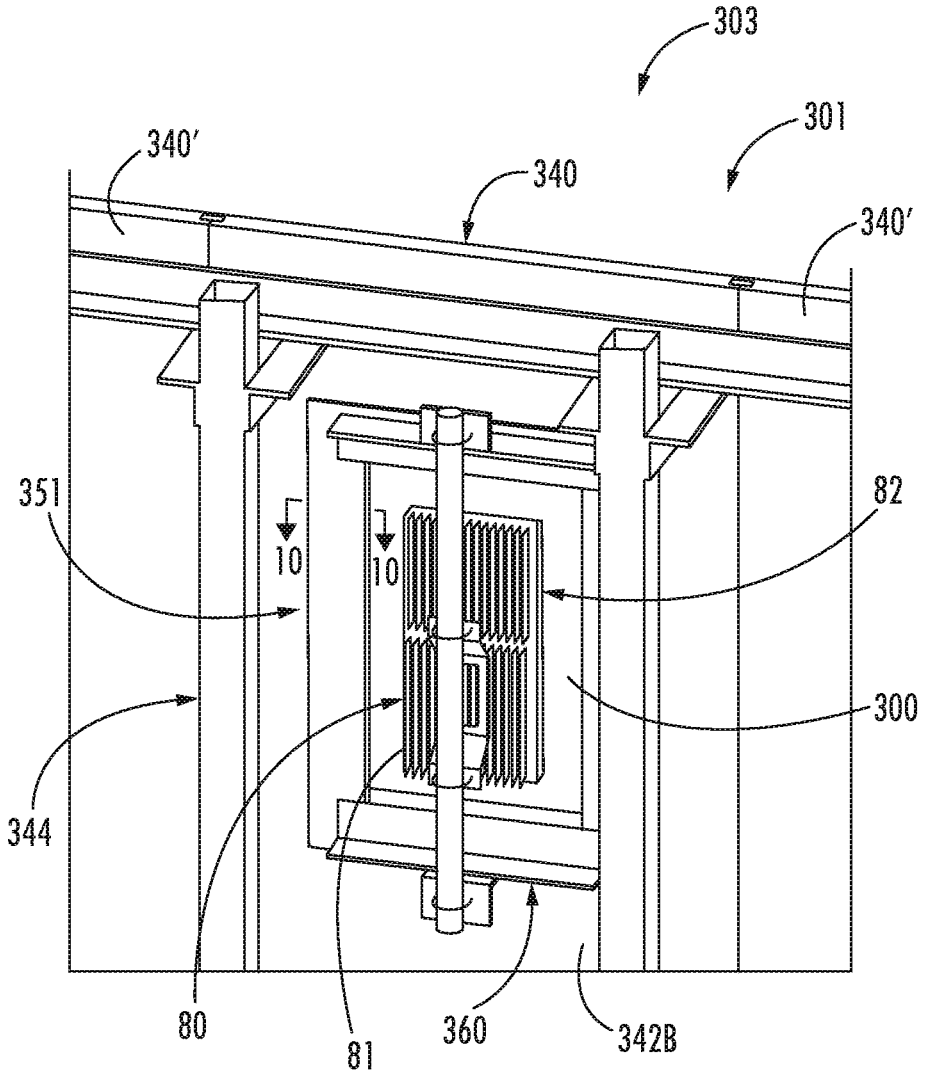
FIG. 8 is a rear perspective view of a wireless communication equipment installation according to some embodiments.
Figure 9:
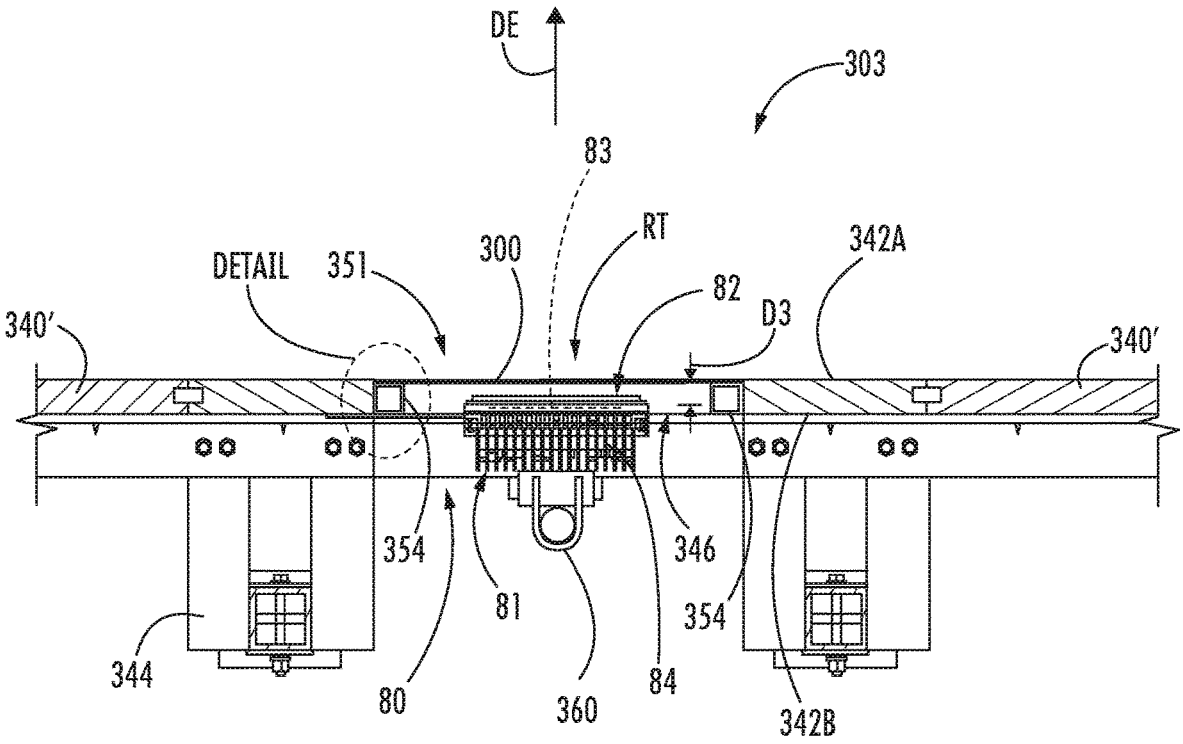
FIG. 9 is a top view of the wireless communication equipment installation of FIG. 8.
Figure 10:
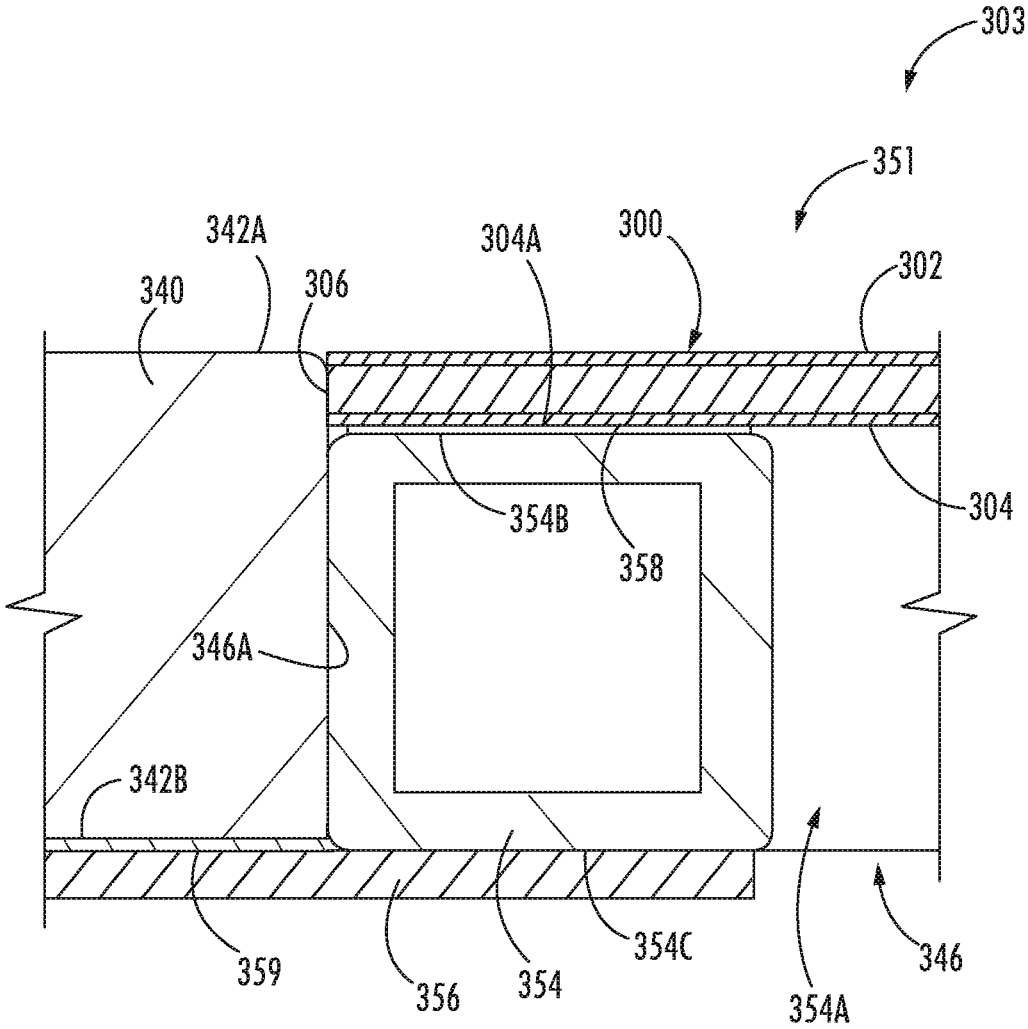
FIG. 10 is an enlarged, fragmentary, cross-sectional view of the wireless communication equipment installation of FIG. 8.
Figure 11:
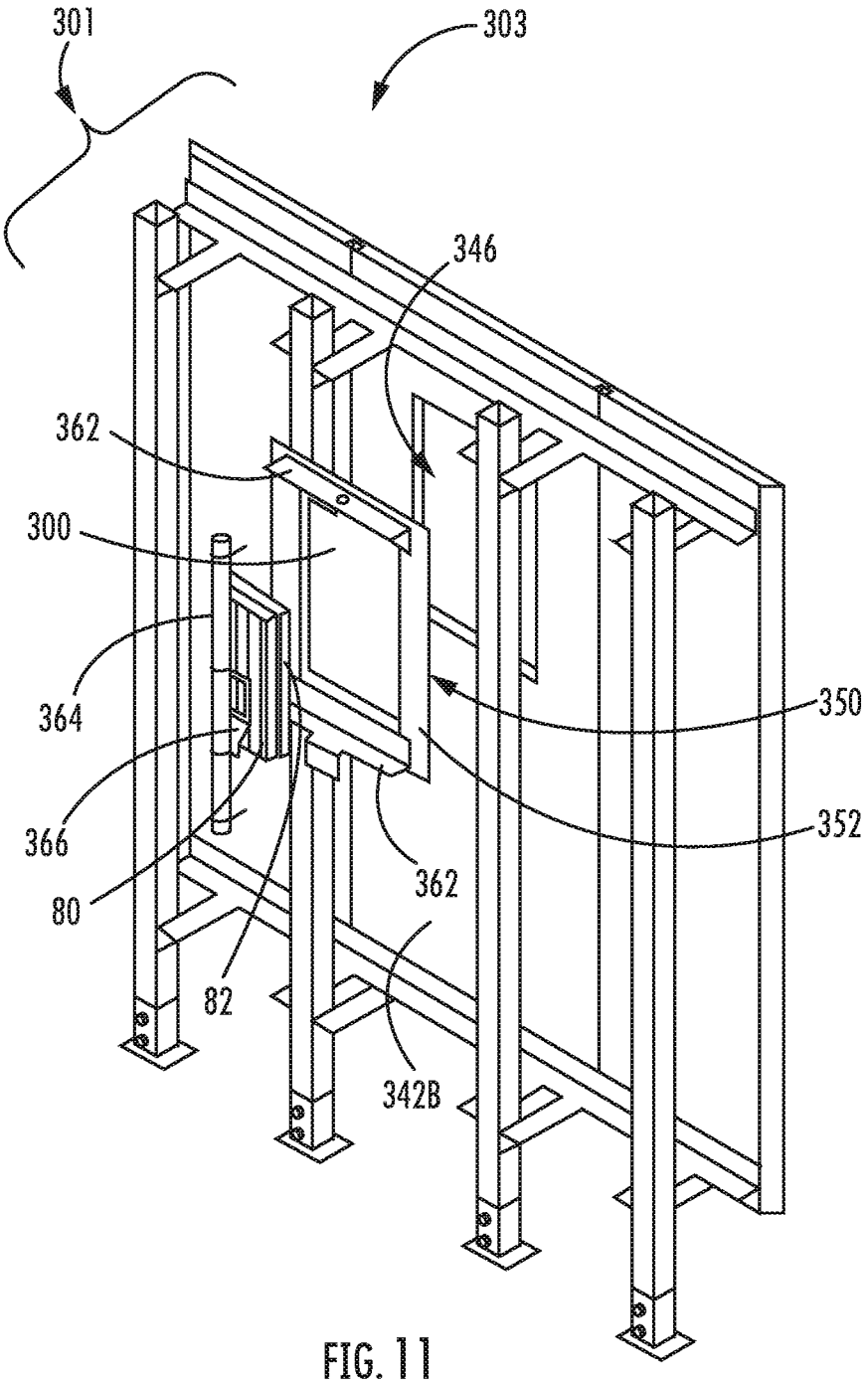
FIG. 11 is an exploded, rear perspective view of the wireless communication equipment installation of FIG. 8.

The wireless equipment 80 is constructed and operates in the same manner as described above for the wireless communication equipment installation 303 (FIG. 8). Like numbers are used to denote the same elements in the drawings.

The concealment system 601 includes a base concealment member 640, adjacent additional concealment members 640', a support structure 644, a shroud assembly 651, and an antenna mounting system 660 corresponding generally to the base concealment member 340, the concealment members 340', the support structure 344, the shroud assembly 351, and the antenna mounting system 360, respectively, except as discussed below. The concealment system 601 further includes an environmental protection enclosure or rain hood 680.

The base panel 640 has a front face 642A, an opposing rear face 642B, and a window or aperture 646 corresponding to the front face 342A, opposing rear face 342B, and aperture 346.

The shroud assembly 651 includes a shroud member 600 and a shroud mounting system 650.

The shroud member 600 is constructed as described above for the shroud member 200. Accordingly, the disclosure herein regarding the shroud member 200 and shroud members according to embodiments of the invention generally likewise applies to the shroud member 600. The shroud member 600 includes a front face 602 (corresponding to the front face 202), and a rear face 604 (corresponding to the rear face 204).

The shroud mounting system 650 includes a frame 652, a backing member 654, and fasteners 655.

The frame 652 defines an opening 652A. The shroud member 600 is affixed to the frame 652 and completely fills the opening 652A. The shroud member 600 may be affixed to the frame 652 using any suitable technique. For example, in some embodiments, the shroud member 600 is secured to the frame 652 by adhesive that bonds peripheral portions of the shroud member front face 602 to the rear face of the frame 652. The frame 652 may be formed of any suitable material. In some embodiments, the frame 652 is formed of fiberglass reinforced plastic (FRP).

The backing member 654 defines an opening 654A. The backing member 654 may be formed of any suitable material. In some embodiments, the backing member 654 is formed of fiberglass reinforced plastic (FRP).

The rain hood 680 includes a horizontally extending roof portion 682, and opposed, vertically extending side portions. In some embodiments, the rain hood 680 is unitary. The rain hood 680 defines a vertical axis V-V, a horizontal axis H-H, and a depthwise axis D-D (perpendicular to the axes V-V and H-H).

The roof portion 682 includes a horizontally extending main wall 682A, a vertically extending front mounting flange 682B, and a vertically extending, downturned, rear lip or wall 682C.

Each side portion 684 includes a vertically extending main wall 684A, a front mounting flange 684B, and a rear lip or wall 684C.

The roof portion 682 spans the distance between the top ends of the side portions 684 and further includes opposed overhang sections 682D that project laterally outwardly beyond the side portions 684.

The main walls 682A, 684A and the rear walls 682C, 684C define a rain hood chamber or cavity 686. The mount flanges 682B, 684B define a front opening 686A and the rear walls 682C, 684C define a rear opening 686B. Each of these openings 686A, 686B communicate with the cavity 686.

In some embodiments, the rain hood cavity 686 has a depth D9 (FIG. 26) in the range of from about 4 inches to 12 inches.

The rain hood 680 may be formed of any suitable material(s). In some embodiments, the rain hood 680 is formed of a polymeric material. In some embodiments, the rain hood 680 is formed of formed (e.g., molded) or extruded plastic (e.g., ABS). The rain hood 680 may be formed as a single piece or assembled from multiple pieces. In some embodiments and as illustrated, the roof portion 682 and the side portions 684 are each formed as Z-shaped members that are secured to one another by fasteners and/or bonding.

In the installation, the frame 652 is secured to the base panel front face 642A, the rain hood 680 is affixed to the rear face 642B of the base panel 640, and the backing member 654 is interposed between the rain hood 680 and the base panel 640. The components 652, 654, 680 may be secured in this manner using fasteners 655 and/or adhesive, for example. The backing member 654 can serve to reinforce the base panel 640, particularly in the case of a relatively thin base panel 640. However, in other embodiments, the backing member 654 may be omitted.

The frame 652 is mounted about the aperture 646 such that the shroud member 600 covers and is aligned with the aperture 646. The front opening 686A of the rain hood 680 is likewise aligned with the aperture 646. The target region RT of the shroud 600 is thereby aligned with the aperture 646 and the rain hood front opening 686A.

In will be appreciated that the base panel 640, the shroud assembly 651, and the rain hood 680 define an antenna chamber 688 (FIG. 26). The antenna chamber 688 is bounded by the shroud member 600, the main walls 682A, 684A, and the rear walls 682C, 684C.

The antenna 80 is mounted in alignment with target region RT of the shroud 600 using the antenna mounting system 660, as discussed above with regard to the installation 303, for example. The antenna 80 is positioned and disposed in the antenna chamber 688 (see, e.g., FIGS. 25 and 26). The antenna 80 and, in particular, the front face 87 of the antenna 80, is positioned underneath the roof portion 682 and between the rear walls 682C, 684C and the shroud member 600. In some embodiments, the depth D9 (FIG. 26) of the rain hood cavity 686 is great enough to ensure that the entirety of the antenna 80 is positioned beneath the rain hood 680.

The antenna 80 and the front face 87 thereof are thereby partially surrounded by or enveloped in the rain hood 680. The concealment system 601, and in particular the rain hood 680, serves to prevent or inhibit rain water from contacting and collecting on the front face 87 of the antenna 80 and/or on the rear face 604 of the shroud member 600 in the target region RT. It has been found that water (e.g., rain water) on these surfaces and in the path of mm-wave 5G radio signals can be very detrimental to the signal properties of the mm-wave 5G radio signals.

The main walls 682A, 684A serve to shield the antenna 80 and shroud rear face 604 from downwardly and horizontally driven rain. The rear walls 682C, 684C serve to shield the antenna 80 and rear shroud face 604, and also serve as drip edges to direct water away from the antenna 80. In some embodiments (not show), the concealment system 601 includes a rear cover that covers part or all of the rear opening 686B of the rain hood 680.

The shroud assembly 651 and the rain hood 680 can be mounted in an existing base panel 640 in the field (e.g., retro-fitted onsite). For example, an aperture 686 can be cut into an existing screen wall 640 and the shroud assembly 651 and the rain hood 680 can be installed as described. In other embodiments, the shroud assembly 651 and the rain hood 680 can be mounted in a base panel 640 in a factory and provided to a customer or installer as a prefabricated unit. In other embodiments, the shroud assembly 651 and the rain hood 680 can be mounted in a base panel 640 in a factory, the base panel 340 can be incorporated into a larger shield assembly or kit (e.g., including the base panels 640' and the support structure 644) and provided to a customer or installer as a prefabricated concealment unit or kit.

As described above with respect to FIGS. 2-4, a shroud member may be configured for improved electrical or radio signal transmission by adjusting the thickness of a core dielectric layer and/or by matching the impedances of the various layers comprising the shroud member with each other and/or free space. Other factors may be considered, however, when configuring a shroud member, such as structural rigidity for environmental protection, thermal performance, e.g., the ability to evacuate heat generated by the electronics associated with the antenna system, and the like. Thus, in some embodiments of the inventive concept, the thickness of a core dielectric layer may be increased to improve structural integrity for some applications or may be decreased to improve thermal performance in evacuating heat.

Many alternative prescribed or selected constructions, materials, properties, and attributes of the shroud members and shrouds have been described herein. It will be appreciated that each of these alternatives are applicable to each of the embodiments described, and may be combined in any suitable combination. For example, each of the shroud members 200, 300, 400, 500, 600 can have a single layer construction, have a multilayer construction (e.g., a core layer with only one skin layer or both front and rear skin layers), include a foamed PVC layer with or without a nonfoamed PVC skin layer or layers, include a coating, have any electrical properties as described above (e.g., dielectric constant, impedance, insertion loss, surface resistance) or combinations thereof, have any chemical properties, compositions and formulations as described above or combinations thereof, and have any properties or dimensions (e.g., thicknesses, densities, textures, hardness, flexural strength, etc.) as described above or combinations thereof.

Further Definitions and Embodiments

In the above-description of various embodiments of the present disclosure, it is to be understood that the terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. A wireless communication equipment installation, comprising:
- wireless communication equipment including a radiating element configured to emit radio signals; and
- a concealment system including:
  - a base concealment member;
  - an aperture defined in the base concealment member; and
  - a shroud member mounted in or over the aperture;
- wherein:
  - the shroud member is disposed adjacent the radiating element and in the path of radio signals emitted from the radiating element;
  - the base concealment member is formed of a first material;
  - the shroud member is formed of a second material that is different from the first material;
  - the second material is less attenuating of the radio signals emitted from the radiating element than the first material; and
  - the base concealment member is formed of fiberglass reinforced polymer (FRP), plastic, or a plastic and foam composite sandwich.

2. The wireless communication equipment installation of claim 1 wherein the shroud member has a multilayer construction and includes:
- a core layer having a front surface and an opposing rear surface; and
- a skin layer covering the front or rear surface of the core layer;
- wherein:
  - the skin layer comprises a non-foamed polyvinyl chloride (PVC); and
  - the core layer comprises a foamed PVC;
- wherein the radiating element is configured to emit and receive radio signals through the shroud member.

3. The wireless communication equipment installation of claim 2 wherein:
- the skin layer is a front skin layer covering the front surface of the core layer; and
- the shroud member further includes a rear skin layer covering the rear surface of the core layer;
- wherein:
  - the rear skin layer comprises a non-foamed PVC.

4. The wireless communication equipment installation of claim 2 wherein the wireless communication equipment and the radiating element are configured to emit the radio signals having frequencies greater than 24 GHz through the shroud member.

5. The wireless communication equipment installation of claim 2 wherein the first material is stronger than the second material.

6. The wireless communication equipment installation of claim 2 further including a shroud mounting system securing the shroud member to the base concealment member.

7. The wireless communication equipment installation of claim 1 wherein:

the shroud mounting system includes a frame;

the frame is secured to the base concealment member adjacent the aperture; and the shroud member is mounted on the frame.

8. The wireless communication equipment installation of claim 1 wherein the base concealment member and the shroud member are each substantially flat panels.

9. The wireless communication equipment installation of claim 8 wherein the wireless communication equipment and the radiating element are configured to emit radio signals having frequencies greater than 24 GHz through the shroud member.

10. The wireless communication equipment installation of claim 1 wherein:

the shroud member is a substantially flat panel; and the core layer and the skin layer are each substantially planar layers.

11. The wireless communication equipment installation of claim 1 wherein:

the shroud member is a curved radome; and the core layer and the skin layer are each curved layers.

12. The wireless communication equipment installation of claim 9 wherein the frame is bonded to a peripheral portion of the shroud member.

13. The wireless communication equipment installation of claim 9 wherein:

the base concealment member has opposed front and rear faces;

the frame is mounted on the front face of the base concealment member about the aperture; and the shroud mounting system further includes a backing member mounted on the rear face of the base concealment member and coupled to the frame.

14. The wireless communication equipment installation of claim 9 wherein the frame is formed of fiberglass reinforced plastic.

15. The wireless communication equipment installation of claim 1 including an antenna mounting system configured to secure an antenna including the radiating element to the base concealment member.

16. The wireless communication equipment installation of claim 15 wherein the antenna mounting system includes an adjustment mechanism to selectively set a vertical position of the radiating element relative to the aperture.

17. The wireless communication equipment installation of claim 1 wherein:

the wireless communication equipment installation includes an antenna, the antenna including the radiating element and having a front face through which the radio signals are transmitted; and the concealment system includes a rain hood covering the antenna to inhibit rain water from depositing and collecting on the front face of the antenna and/or on a rear surface of the shroud member in front of the antenna.

18. The wireless communication equipment installation of claim 1 wherein:

the shroud member has a multilayer construction and includes:

a core layer having a front surface and an opposing rear surface; and a skin layer covering the front or rear surface of the core layer;

the skin layer comprises a first dielectric material;

the core layer comprises a foamed second dielectric material; and the skin layer is bonded to the front or rear surface of the core layer.

19. The wireless communication equipment installation of claim 1 wherein the shroud member has an insertion loss of less than about −0.5 dB for frequencies of the radio signals in a range of about 25 GHz to about 40 GHz.

20. The wireless communication equipment installation of claim 19 wherein a radiation pattern through the shroud member that has a half-power beamwidth angle that deviates less than two degrees relative to a half-power beamwidth angle associated with a radiation pattern generated through free space for frequencies of the radio signals in a range of about 25 GHz to about 52 GHz.

21. The wireless communication equipment installation of claim 1 wherein:

the radiating element is spaced apart from the shroud member at a distance in the range of from of about 5 mm to about 60 mm; and the antenna transmits millimeter-wave 5G radio signals at an angle of incidence of about 0° to about 60° relative to a surface of the shroud member.

22. The wireless communication equipment installation of claim 1 wherein the radiating element is configured to generate a radiation pattern through the shroud member that has a max gain of a main lobe that deviates from a max gain of a main lobe associated with a radiation pattern generated through free space by not more than about 0.5 dB.

23. The wireless communication equipment installation of claim 1 wherein the shroud member includes a polyvinyl chloride (PVC) substrate.

24. The wireless communication equipment installation of claim 23 wherein the shroud member further comprises a coating on a surface of the PVC substrate.

25. The wireless communication equipment installation of claim 1 wherein the base concealment member is formed of fiberglass reinforced polymer (FRP).

26. The wireless communication equipment installation of claim 9 wherein:

the base concealment member has opposed front and rear faces;

the frame and the shroud member overlie the front face and the shroud member is interposed between the front face and the frame; and the shroud mounting system includes fasteners and each of the fasteners extends through the frame, the shroud member, and the base concealment member to secure the shroud member to the base concealment member.

27. The wireless communication equipment installation of claim 26 wherein:

the shroud mounting system includes a backing member mounted on the rear face of the base concealment member; and the fasteners extend through the backing member.

28. A wireless communication equipment installation, comprising:

wireless communication equipment including a radiating element configured to emit radio signals; and a concealment system including:

a base concealment member having opposed front and rear faces;

an aperture defined in the base concealment member;

a shroud member mounted in or over the aperture; and a shroud mounting system securing the shroud member to the base concealment member, wherein the shroud mounting system includes a frame and fasteners;

wherein:

the shroud member is disposed adjacent the radiating element and in the path of radio signals emitted from the radiating element;

the base concealment member is formed of a first material;

the shroud member is formed of a second material that is different from the first material;

the second material is less attenuating of the radio signals emitted from the radiating element than the first material;

the frame is secured to the base concealment member adjacent the aperture;

the shroud member is mounted on the frame;

the frame and the shroud member overlie the front face and the shroud member is interposed between the front face and the frame; and each of the fasteners extends through the frame, the shroud member, and the base concealment member to secure the shroud member to the base concealment member.

29. The wireless communication equipment installation of claim 28 wherein:

the shroud mounting system includes a backing member mounted on the rear face of the base concealment member; and the fasteners extend through the backing member.

30. A wireless communication equipment installation, comprising:

wireless communication equipment including a radiating element configured to emit radio signals; and a concealment system including:

a base concealment member having opposed front and rear faces;

an aperture defined in the base concealment member;

a shroud member mounted in or over the aperture; and a shroud mounting system securing the shroud member to the base concealment member wherein the shroud mounting system includes a frame, a backing member, and fasteners;

wherein:

the shroud member is disposed adjacent the radiating element and in the path of radio signals emitted from the radiating element;

the base concealment member is formed of a first material;

the shroud member is formed of a second material that is different from the first material;

the second material is less attenuating of the radio signals emitted from the radiating element than the first material;

the frame is secured to the base concealment member adjacent the aperture;

the shroud member is mounted on the frame;

the frame is mounted on the front face of the base concealment member about the aperture;

the backing member is mounted on the rear face of the base concealment member and coupled to the frame; and the fasteners extend through the frame, the base concealment member and the backing member to secure the shroud member to the base concealment member.

* * * * *